US008187122B2

(12) United States Patent
Brekke et al.

(10) Patent No.: US 8,187,122 B2
(45) Date of Patent: May 29, 2012

(54) CLUB FITTING SYSTEM

(75) Inventors: Dustin J. Brekke, Fountain Valley, CA (US); David Hunter, Seal Beach, CA (US); Ruben Padilla, Gardena, CA (US)

(73) Assignee: SRI Sports Limited, Kobe-shi (JP)

( * ) Notice: Subject to any disclaimer, the term of this patent is extended or adjusted under 35 U.S.C. 154(b) by 0 days.

(21) Appl. No.: 12/895,141

(22) Filed: Sep. 30, 2010

(65) Prior Publication Data

US 2011/0111873 A1 May 12, 2011

Related U.S. Application Data

(60) Provisional application No. 61/259,382, filed on Nov. 9, 2009.

(51) Int. Cl.
*A63B 69/36* (2006.01)

(52) U.S. Cl. ..... 473/409; 473/219

(58) Field of Classification Search ..... 473/219, 473/226, 237, 244, 246, 257, 261, 262, 266, 473/278, 279, 409
See application file for complete search history.

(56) References Cited

U.S. PATENT DOCUMENTS

| | | | | |
|---|---|---|---|---|
| 2,879,996 | A | 3/1959 | Lederer | |
| 2,937,875 | A | 5/1960 | Mason et al. | |
| 3,411,789 | A | 11/1968 | Wariner | |
| 3,427,031 | A | 2/1969 | Scott | |
| 3,430,964 | A | 3/1969 | Budzinski | |
| 3,529,831 | A | 9/1970 | Rogers | |
| 3,563,553 | A | 2/1971 | Baldwin et al. | |
| 3,633,917 | A | 1/1972 | Anderson | |
| 3,633,918 | A | 1/1972 | Smiley | |
| 3,639,923 | A | 2/1972 | Stewart | |
| 3,693,979 | A | 9/1972 | Koett | |
| 3,784,208 | A | 1/1974 | Weygandt | |
| 232,567 | A | 8/1974 | Golden | |
| 3,869,127 | A | 3/1975 | Kohori | |
| 3,936,055 | A * | 2/1976 | Scott | 473/160 |
| 3,975,024 | A | 8/1976 | Stephan | |
| 3,992,013 | A | 11/1976 | Golden | |
| 3,999,765 | A | 12/1976 | Bishop | |
| 4,279,420 | A | 7/1981 | Bay et al. | |
| 4,311,312 | A | 1/1982 | O'Brien | |
| 4,331,332 | A | 5/1982 | Hughes | |
| 4,432,552 | A | 2/1984 | Saverino | |

(Continued)

FOREIGN PATENT DOCUMENTS

| | | |
|---|---|---|
| JP | A-11-57100 | 3/1999 |

(Continued)

*Primary Examiner* — Nini Legesse
(74) *Attorney, Agent, or Firm* — Oliff & Berridge, PLC

(57) ABSTRACT

A method of determining a reference lie angle for at least one iron-type golf club custom-fit for a player, according to one or more aspects of the present invention, comprises providing a first hitting surface and a second hitting surface, the first hitting surface being different from the second hitting surface; providing a test club comprising a data acquisition device; directing the player to swing the test club relative to the first hitting surface, whereby initial information is collected by the data acquisition device; determining whether the initial information collected by the data acquisition device satisfies a pre-set condition; if the condition is satisfied, directing the player to swing the test club relative to the second hitting surface, whereby supplemental information is collected by the data acquisition device; and evaluating the supplemental information collected by the data acquisition device to determine the reference lie angle.

7 Claims, 16 Drawing Sheets

U.S. PATENT DOCUMENTS

| | | | |
|---|---|---|---|
| 4,468,034 | A | 8/1984 | Duclos |
| 4,522,406 | A | 6/1985 | Tarquinio |
| 4,566,696 | A | 1/1986 | Horgen |
| 4,613,133 | A | 9/1986 | Selberg et al. |
| 4,875,684 | A | 10/1989 | Benilan |
| 4,875,685 | A | 10/1989 | Ballinger et al. |
| 306,752 | A | 3/1990 | Crump |
| 4,932,662 | A | 6/1990 | Blaisdell |
| 5,005,837 | A | 4/1991 | Urra Martinez |
| 5,046,741 | A | 9/1991 | Ahn |
| 5,308,075 | A | 5/1994 | Theriault |
| 5,333,875 | A | 8/1994 | Wilson |
| 5,333,876 | A | 8/1994 | Goto |
| 5,340,111 | A | 8/1994 | Froelich |
| 5,351,962 | A | 10/1994 | Lin |
| 5,358,251 | A | 10/1994 | Ashton |
| 353,433 | A | 12/1994 | Erdoes et al. |
| 5,421,579 | A | 6/1995 | Uebele, Jr. |
| 5,431,406 | A | 7/1995 | Ishii |
| 5,460,379 | A | 10/1995 | Cleland |
| 5,470,074 | A | 11/1995 | Hotchkiss et al. |
| 5,518,245 | A | 5/1996 | Nelson |
| 5,524,893 | A | 6/1996 | McGinnis et al. |
| 5,549,522 | A | 8/1996 | Chang |
| 5,558,334 | A | 9/1996 | Roche |
| 5,609,530 | A | 3/1997 | Butler, Jr. |
| 5,720,670 | A | 2/1998 | Oxley et al. |
| 5,803,826 | A | 9/1998 | Perrine |
| 5,820,478 | A | 10/1998 | Wood et al. |
| 5,910,053 | A | 6/1999 | Scalise |
| 5,916,037 | A | 6/1999 | Hill |
| 5,944,615 | A | 8/1999 | Lee |
| 5,984,802 | A | 11/1999 | Perrine |
| 6,033,317 | A | 3/2000 | Beam |
| 6,086,483 | A | 7/2000 | Brown |
| 6,102,811 | A | 8/2000 | Henry |
| 6,120,386 | A | 9/2000 | Hill |
| 6,135,895 | A | 10/2000 | Estivo et al. |
| 6,155,931 | A | 12/2000 | Perrine |
| 6,179,724 | B1 | 1/2001 | Yang et al. |
| 6,312,345 | B1 | 11/2001 | Pelz |
| 6,450,895 | B1 | 9/2002 | Galluzzo, Jr. |
| 6,471,599 | B2 | 10/2002 | Ford |
| 6,485,374 | B1 | 11/2002 | Myerscough |
| 6,514,152 | B1 | 2/2003 | Huang et al. |
| 6,663,498 | B2 | 12/2003 | Stipan |
| 6,726,574 | B2 | 4/2004 | Kim |
| 6,729,967 | B2 | 5/2004 | Ford |
| D491,246 | S | 6/2004 | Walsh et al. |
| 6,793,587 | B2 | 9/2004 | Llewellyn et al. |
| 6,913,544 | B2 | 7/2005 | Tiffin |
| 6,921,342 | B2 | 7/2005 | Jong |
| 7,056,223 | B2 | 6/2006 | Wohldorf |
| 7,131,911 | B2 | 11/2006 | Kim |
| 7,195,565 | B2 | 3/2007 | White et al. |
| D557,366 | S | 12/2007 | Witt et al. |
| 2001/0044344 | A1 | 11/2001 | Leonard et al. |
| 2002/0128084 | A1 | 9/2002 | Lee et al. |
| 2002/0187848 | A1 | 12/2002 | Tomczyk |
| 2003/0216189 | A1 | 11/2003 | Tiffin |
| 2004/0209700 | A1 | 10/2004 | Tiffin |
| 2005/0113182 | A1 | 5/2005 | Kim |
| 2006/0128493 | A1 | 6/2006 | Snopkowski |
| 2006/0172813 | A1 | 8/2006 | Tiffin et al. |
| 2007/0191128 | A1 | 8/2007 | Tirol |
| 2008/0085779 | A1 | 4/2008 | Nagai et al. |
| 2009/0326688 | A1 * | 12/2009 | Thomas et al. ..... 700/91 |

FOREIGN PATENT DOCUMENTS

| | | |
|---|---|---|
| JP | A-11-276656 | 10/1999 |
| JP | A-2000-297519 | 10/2000 |
| JP | A-2006-218136 | 8/2006 |

* cited by examiner

CLUB FITTING SYSTEM

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

Iron-type clubs are generally intended to be used as a set, and the specifications of iron-type clubs generally progress throughout at least a portion of the set. Certain club specifications, e.g., lie angle, are crucial to achieving shot consistency and are dictated by the swing type and physical characteristics of the player. Therefore, individual players must be properly fitted to optimize these parameters in their iron sets and to obtain maximum performance from their equipment. During the fitting process, club specifications for the entire set are typically determined by evaluating a player's swing relative to a planar lie board using, e.g., a plurality of 7 irons, wherein each test iron has a distinct set of specifications.

In existing lie board fitting methods, the ideal lie angle for a player is generally identified by determining the point of contact between the sole of the test club and the lie board during a test shot by the player. As shown in FIGS. 1-3, lie tape 112 is initially applied to the sole 108 of test club 100 and a reference line 111, substantially perpendicular to the leading edge 124, is then marked on the lie tape 112 proximate a face centerline 118. Referring to FIGS. 4 and 5, the "face centerline," as used herein, denotes an imaginary line defined by the intersection of the strike face 123 with an imaginary vertical plane 115 that is oriented substantially perpendicular to the leading edge 124 and passes through a face center 110, with the club head of the test club in an address position.

Referring again to FIG. 3, after the reference line has been marked on the lie tape, the player swings the test club relative to the lie board. The impact between the sole of the club head and the lie board produces a scarred or torn area in the lie tape at the point of contact. For each ¼ inch the point of sole impact is on the toe side of the reference line, the correct lie angle will be 1° more upright than the lie of the test club. For each ¼ inch the sole impact is on the heel side of the reference line, the correct lie angle will be 1° more flat than the lie of the test club. However, conventional fitting carts generally require a large number of "confirmation clubs," so that the player may verify their test results with a club head having the appropriate lie angle. Accordingly, conventional fitting carts are generally expensive and can be cumbersome to transport.

SUMMARY

The present invention, in one or more aspects thereof, may advantageously comprise a more efficient fitting apparatus and method that reduce the number of clubs required to properly fit the player.

In one example, a method of determining a reference lie angle for at least one iron-type golf club custom-fit for a player comprises (a) providing a primary lie board having a horizontal hitting surface; (b) providing a secondary lie board having an oblique hitting surface inclined relative to the horizontal surface, the secondary lie board comprising a flat lie-angle orientation and an upright lie-angle orientation; (c) providing a test club comprising a sole and a test lie angle, the test club having a predetermined relationship with the at least one iron-type golf club; (d) providing a gauge comprising a toe region, a heel region, and an intermediate region; (e) applying the gauge to the sole of the test club; (f) directing the player to swing the test club relative to the horizontal hitting surface to impact the gauge against the horizontal hitting surface, whereby a first witness mark is produced on the gauge; (g) identifying whether the first witness mark is proximate the toe region, the heel region, or the intermediate region; (h) if the first witness mark is proximate the intermediate region, selecting the at least one iron-type golf club wherein the reference lie angle is substantially equal to the test lie angle; (i) if the first witness mark is proximate the heel region, directing the player to swing the test club relative to the oblique hitting surface, with the secondary lie board in the flat lie-angle orientation, to impact the gauge against the oblique hitting surface, whereby a second witness mark is produced on the gauge; (j) identifying whether the second witness mark of step (i) is proximate the toe region, the heel region, or the intermediate region, the toe region associated with a first flat lie-angle value, the intermediate region associated with a second flat lie-angle value, and the heel region associated a third flat lie-angle value; (k) if the second witness mark of step (i) is proximate the toe region, selecting the at least one iron-type golf club wherein the reference lie angle is substantially equal to the difference between the test lie angle and the first flat lie-angle value; (l) if the second witness mark of step (i) is proximate the intermediate region, selecting the at least one iron-type golf club wherein the reference lie angle is substantially equal to the difference between the test lie angle and the second flat lie-angle value; (m) if the second witness mark of step (i) is proximate the heel region, selecting the at least one iron-type golf club wherein the reference lie angle is substantially equal to the difference between the test lie angle and the second flat lie-angle value; (n) if the first witness mark is proximate the toe region, directing the player to swing the test club off the oblique hitting surface, with the secondary lie board in the upright lie-angle orientation, to impact the gauge against the oblique hitting surface, whereby the second witness mark is produced on the gauge; (o) identifying whether the second witness mark of step (n) is proximate the toe region, the heel region, or the intermediate region, the toe region associated with a first upright lie-angle value, the intermediate region associated with a second upright lie-angle value, and the heel region associated with a third upright lie-angle value; (p) if the second witness mark of step (n) is proximate the toe region, selecting the at least one iron-type golf club wherein the reference lie angle is substantially equal to the sum of the test lie angle and the first upright lie-angle value; (q) if the second witness mark of step (n) is proximate the intermediate region, selecting the at least one iron-type golf club wherein the reference lie angle is substantially equal to the sum of the test lie angle and the second upright lie-angle value; and (r) if the second witness mark of step (n) is proximate the heel region, selecting the at least one iron-type golf club wherein the reference lie angle is substantially equal to the sum of the test lie angle and the third upright lie-angle value.

In another example, a method of determining a reference lie angle for at least one iron-type golf club custom-fit for a player comprises (a) providing a horizontal hitting surface; (b) providing an oblique hitting surface inclined relative to the horizontal surface, the oblique hitting surface comprising a flat lie-angle orientation and an upright lie-angle orientation; (c) providing a test club comprising a sole and a test lie angle, the test club having a predetermined relationship with the at least one iron-type golf club; (d) providing a gauge comprising a toe region, a heel region, and a intermediate region; (e)

applying the gauge to the sole of the test club; (f) directing the player to swing the test club relative to the horizontal hitting surface to impact the gauge against the horizontal hitting surface, whereby a first witness mark is produced on the gauge; (g) identifying whether the first witness mark is proximate the toe region, the heel region, or the intermediate region; (h) if the first witness mark is proximate the intermediate region, selecting the at least one iron-type golf club wherein the reference lie angle is substantially equal to the test lie angle; (i) if the first witness mark is proximate the heel region, directing the player to swing the test club relative to the oblique hitting surface, with the oblique hitting surface in the flat lie-angle orientation, to impact the gauge against the oblique hitting surface, whereby a second witness mark is produced on the gauge; (j) identifying whether the second witness mark of step (i) is proximate the toe region, the heel region, or the intermediate region, the toe region associated with a first flat lie-angle value, the intermediate region associated with a second flat lie-angle value, and the heel region associated with a third flat lie-angle value; (k) if the second witness mark of step (i) is proximate the toe region, selecting the at least one iron-type golf club wherein the reference lie angle is substantially equal to the difference between the test lie angle and the first flat lie-angle value; (l) if the second witness mark of step (i) is proximate the intermediate region, selecting the at least one iron-type golf club wherein the reference lie angle is substantially equal to the difference between the lie angle and the second flat lie-angle value; (m) if the second witness mark of step (i) is proximate the heel region, selecting the at least one iron-type golf club wherein the reference lie angle is substantially equal to the difference between the test lie angle and the third flat lie-angle value; (n) if the first witness mark is proximate the toe region, directing the player to swing the test club relative to the oblique hitting surface, with the oblique hitting surface in the upright lie-angle orientation, to impact the gauge against the oblique hitting surface, whereby the second witness mark is produced on the gauge; (o) identifying whether the second witness mark of step (n) is proximate the toe region, the heel region, or the intermediate region, the toe region associated with a first upright lie-angle value, the intermediate region associated with a second upright lie-angle value, and the heel region associated with a third upright lie-angle value; (p) if the second witness mark of step (n) is proximate the toe region, selecting the at least one iron-type golf club wherein the reference lie angle is substantially equal to the sum of the test lie angle and the first upright lie-angle value; (q) if the second witness mark of step (n) is proximate the intermediate region, selecting the at least one iron-type golf club wherein the reference lie angle is substantially equal to the sum of the test lie angle and the second upright lie-angle value; and (r) if the second witness mark of step (n) is proximate the heel region, selecting the at least one iron-type golf club wherein the reference lie angle is substantially equal to the sum of the test lie angle and the third upright lie-angle value.

In another example, a method of determining a reference lie angle for at least one iron-type golf club custom-fit for a player comprises (a) providing a horizontal hitting surface; (b) providing an oblique hitting surface inclined relative to the horizontal surface, the oblique hitting surface comprising a flat lie-angle orientation and an upright lie-angle orientation; (c) providing a test club comprising a sole and a test lie angle, the test club having a predetermined relationship with the at least one iron-type golf club; (d) providing a first gauge and a second gauge, each comprising a toe region, a heel region, and a intermediate region; (e) applying the first gauge to the sole of the test club; (f) directing the player to swing the test club relative to the horizontal hitting surface to impact the first gauge against the horizontal hitting surface, whereby a first witness mark is produced on the first gauge; (g) identifying whether the first witness mark is proximate the toe region, the heel region, or the intermediate region; (h) if the first witness mark is proximate the intermediate region, selecting the at least one iron-type golf club wherein the reference lie angle is substantially equal to the test lie angle; (i) if the first witness mark is proximate the heel region, removing the first gauge from the sole of the test club, applying the second gauge to the sole of the test club, directing the player to swing the test club relative to the oblique hitting surface, with the oblique hitting surface in the flat lie-angle orientation, to impact the second gauge against the oblique hitting surface, whereby a second witness mark is produced on the second gauge; (j) identifying whether the second witness mark of step (i) is proximate the toe region, the heel region, or the intermediate region, the toe region associated with a first flat lie-angle value, the intermediate region associated with a second flat lie-angle value, and the heel region associated with a third flat lie-angle value; (k) if the second witness mark of step (i) is proximate the toe region, selecting the at least one iron-type golf club wherein the reference lie angle is substantially equal to the difference between the test lie angle and the first flat lie-angle value; (l) if the second witness mark of step (i) is proximate the intermediate region, selecting the at least one iron-type golf club wherein the reference lie angle is substantially equal to the difference between the test lie angle and the second flat lie-angle value; (m) if the second witness mark of step (i) is proximate the heel region, selecting the at least one iron-type golf club wherein the reference lie angle is substantially equal to the difference between the test lie angle and the third flat lie-angle value; (n) if the first witness mark is proximate the toe region, removing the first gauge from the sole of the test club, applying the second gauge to the sole of the test club, directing the player to swing the test club relative to the oblique hitting surface, with the oblique hitting surface in the upright lie-angle orientation, to impact the second gauge against the oblique hitting surface, whereby the second witness mark is produced on the second gauge; (o) identifying whether the second witness mark of step (n) is proximate the toe region, the heel region, or the intermediate region, the toe region associated with a first upright lie-angle value, the intermediate region associated with a second upright lie-angle value, and the heel region associated with a third upright lie-angle value; (p) if the second witness mark of step (n) is proximate the toe region, selecting the at least one iron-type golf club wherein the reference lie angle is substantially equal to the sum of the test lie angle and the first upright lie-angle value; (q) if the second witness mark of step (n) is proximate the intermediate region, selecting the at least one iron-type golf club wherein the reference lie angle is substantially equal to the sum of the test lie angle and the second upright lie-angle value; and (r) if the second witness mark of step (n) is proximate the heel region, selecting the at least one iron-type golf club wherein the reference lie angle is substantially equal to the sum of the test lie angle and the third upright lie-angle value.

In yet another example, a method of determining a reference lie angle for at least one iron-type golf club custom-fit for a player comprises (a) providing a horizontal hitting surface; (b) providing an oblique hitting surface inclined relative to the horizontal surface, the oblique hitting surface comprising a flat lie-angle orientation and an upright lie-angle orientation; (c) providing a test club comprising a sole and a test lie angle, the test club having a predetermined relationship with the at least one iron-type golf club; (d) providing a gauge comprising a toe region, a heel region, and a intermediate region; (e) applying the gauge to the sole of the test club; (f) directing the player to perform at least two test swings relative to the horizontal hitting surface to impact the gauge against the horizontal hitting surface, whereby at least two first witness marks are produced on the gauge; (g) identifying whether a majority of the at least two first witness marks is proximate the toe region, the heel region, or the intermediate region; (h) if the majority of the at least two first witness marks is proximate the intermediate region, selecting the at least one iron-type golf club wherein the reference lie angle is substantially equal to the test lie angle; (i) if the majority of the at least two first witness marks is proximate the heel region, directing the player to perform at least two test swings relative to the oblique hitting surface, with the oblique hitting surface in the flat lie-angle orientation, to impact the gauge against the oblique hitting surface, whereby at least two second witness marks are produced on the gauge; (j) identifying whether a majority of the at least two second witness marks of step (i) is proximate the toe region, the heel region, or the intermediate region, the toe region associated with a first flat lie-angle value, the intermediate region associated with a second flat lie-angle value, and the heel region associated with a third flat lie-angle value; (k) if the majority of the at least two second witness marks of step (i) is proximate the toe region, selecting the at least one iron-type golf club wherein the reference lie angle is substantially equal to the difference between the test lie angle and the first flat lie-angle value; (l) if the majority of the at least two second witness marks of step (i) is proximate the intermediate region, selecting the at least one iron-type golf club wherein the reference lie angle is substantially equal to the difference between the test lie angle and the second flat lie-angle value; (m) if the majority of the at least two second witness marks of step (i) is proximate the heel region, selecting the at least one iron-type golf club wherein the reference lie angle is substantially equal to the difference between the test lie angle and the third flat lie-angle value; (n) if the majority of the at least two first witness marks is proximate the toe region, directing the player to perform a plurality of test swings relative to the oblique hitting surface, with the oblique hitting surface in the upright lie-angle orientation, to impact the gauge against the oblique hitting surface, whereby the at least two second witness marks are produced on the gauge; (o) identifying whether the majority of the at least two second witness marks of step (n) is proximate the toe region, the heel region, or the intermediate region, the toe region associated with a first upright lie-angle value, the intermediate region associated with a second upright lie-angle value, and the heel region associated with a third upright lie-angle value; (p) if the majority of the at least two second witness marks of step (n) is proximate the toe region, selecting the at least one iron-type golf club wherein the reference lie angle is substantially equal to the sum of the test lie angle and the first upright lie-angle value; (q) if the majority of the at least two second witness marks of step (n) is proximate the intermediate region, selecting the at least one iron-type golf club wherein the reference lie angle is substantially equal to the sum of the test lie angle and the second upright lie-angle value; and (r) if the majority of the at least two second witness marks of step (n) is proximate the heel region, selecting the at least one iron-type golf club wherein the reference lie angle is substantially equal to the sum of the test lie angle and the third upright lie-angle value.

In yet another example, a method of determining a reference lie angle for at least one iron-type golf club custom-fit for a player comprises (a) providing a horizontal hitting surface; (b) providing an oblique hitting surface inclined relative to the horizontal surface, the oblique hitting surface comprising a flat lie-angle orientation and an upright lie-angle orientation; (c) providing a test club comprising a sole and a test lie angle, the test club having a predetermined relationship with the at least one iron-type golf club; (d) providing a first gauge and a second gauge, each comprising a toe region, a heel region, and a intermediate region; (e) applying the gauge to the sole of the test club; (f) directing the player to perform at least two test swings relative to the horizontal hitting surface to impact the first gauge against the horizontal hitting surface, whereby at least two first witness marks are produced on the first gauge; (g) identifying whether a majority of the at least two first witness marks is proximate the toe region, the heel region, or the intermediate region; (h) if a majority of the at least two first witness marks are proximate the intermediate region, selecting the at least one iron-type golf club wherein the reference lie angle is substantially equal to the test lie angle; (i) if the majority of the at least two first witness marks is proximate the heel region, removing the first gauge from the sole of the test club, applying the second gauge to the sole of the test club, directing the player to perform at least two test swings relative to the oblique hitting surface, with the oblique hitting surface in the flat lie-angle orientation, to impact the gauge against the oblique hitting surface, whereby at least two second witness marks are produced on the gauge; (j) identifying whether a majority of the at least two second witness marks of step (i) is proximate the toe region, the heel region, or the intermediate region, the toe region associated with a first flat lie-angle value, the intermediate region associated with a second flat lie-angle value, and the heel region associated with a third flat lie-angle value; (k) if the majority of the at least two second witness marks of step (i) is proximate the toe region, selecting the at least one iron-type golf club wherein the reference lie angle is substantially equal to the difference between the test lie angle and the first flat lie-angle value; (l) if the majority of the at least two second witness marks of step (i) is proximate the intermediate region, selecting the at least one iron-type golf club wherein the reference lie angle is substantially equal to the difference between the test lie angle and the second flat lie-angle value; (m) if the majority of the at least two second witness marks of step (i) is proximate the heel region, selecting the at least one iron-type golf club wherein the reference lie angle is substantially equal to the difference between the test lie angle and the third flat lie-angle value; (n) if the majority of the at least two first witness marks is proximate the toe region, removing the first gauge from the sole of the test club, applying the second gauge to the sole of the test club, directing the player to perform at least two test swings relative to the oblique hitting surface, with the oblique hitting surface in the upright lie-angle orientation, to impact the gauge against the oblique hitting surface, whereby the at least two second witness marks are produced on the gauge; (o) identifying whether the majority of the at least two second witness marks of step (n) is proximate the toe region, the heel region, or the intermediate region, the toe region associated with a first upright lie-angle value, the intermediate region associated with a second upright lie-angle value, and the heel region associated with a third upright lie-angle value; (p) if the majority of the at least two second witness marks of step (n) is proximate the toe region, selecting the at least one iron-type golf club wherein the reference lie angle is substantially equal to the sum of the test lie angle and the first upright lie-angle value; (q) if the majority of the at least two second witness marks of step (n) is proximate the intermediate region, selecting the at least one iron-type golf club wherein the reference lie angle is substantially equal to the sum of the test lie angle and the second upright lie-angle value; and (r) if the majority of the at least two second witness marks of step (n) is proximate the heel region, selecting the at least one iron-type golf club wherein the reference lie angle is substantially equal to the sum of the test lie angle and the third upright lie-angle value.

In yet another example, a method of determining a reference lie angle for at least one iron-type golf club custom-fit for a player comprises providing a first hitting surface and a second hitting surface, the first hitting surface being different from the second hitting surface; providing a test club comprising a data acquisition device; directing the player to swing the test club relative to the first hitting surface, whereby initial information is collected by the data acquisition device; determining whether the initial information collected by the data acquisition device satisfies a pre-set condition; if the condition is satisfied, directing the player to swing the test club relative to the second hitting surface, whereby supplemental information is collected by the data acquisition device; and evaluating the supplemental information collected by the data acquisition device to determine the reference lie angle.

In yet another example, a plurality of lie boards for determining a reference lie angle for at least one iron-type club custom-fit for a player comprises a first lie board having a horizontal surface and a second lie board having an oblique surface.

These and other features and advantages of the fitting apparatus and method according to the invention in its various aspects, as provided by one or more of the examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

Exemplary implementations of the present invention will now be described with reference to the accompanying drawings, wherein:

FIG. 228 is a bottom plan view of the golf club head of FIG. 21A.

For purposes of illustration, these figures are not necessarily drawn to scale. In all the figures, same or similar elements are designated by the same reference numerals.

DETAILED DESCRIPTION

A novel lie board and method for determining a reference lie angle for at least one iron-type golf club custom-fit for a player is disclosed. Those skilled in the art will appreciate the applicability of this lie board and method to right-handed as well as left-handed players. Similarly, the lie board and method are applicable to wedges as well as irons.

Figure 1:
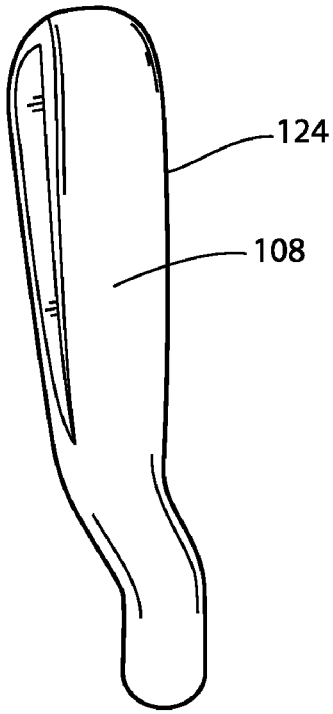
FIG. 1 is a bottom plan view of a golf club head.
Figure 2:
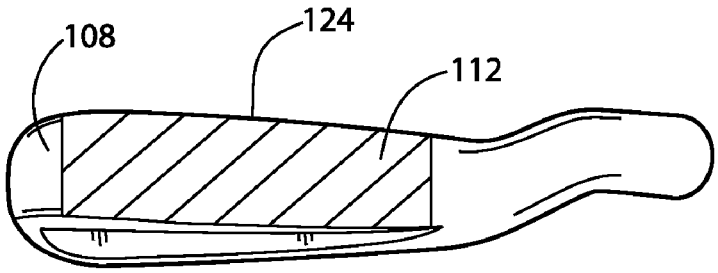
FIG. 2 is a bottom plan view of the golf club head of FIG. 1 with lie tape applied thereto.
Figure 3:
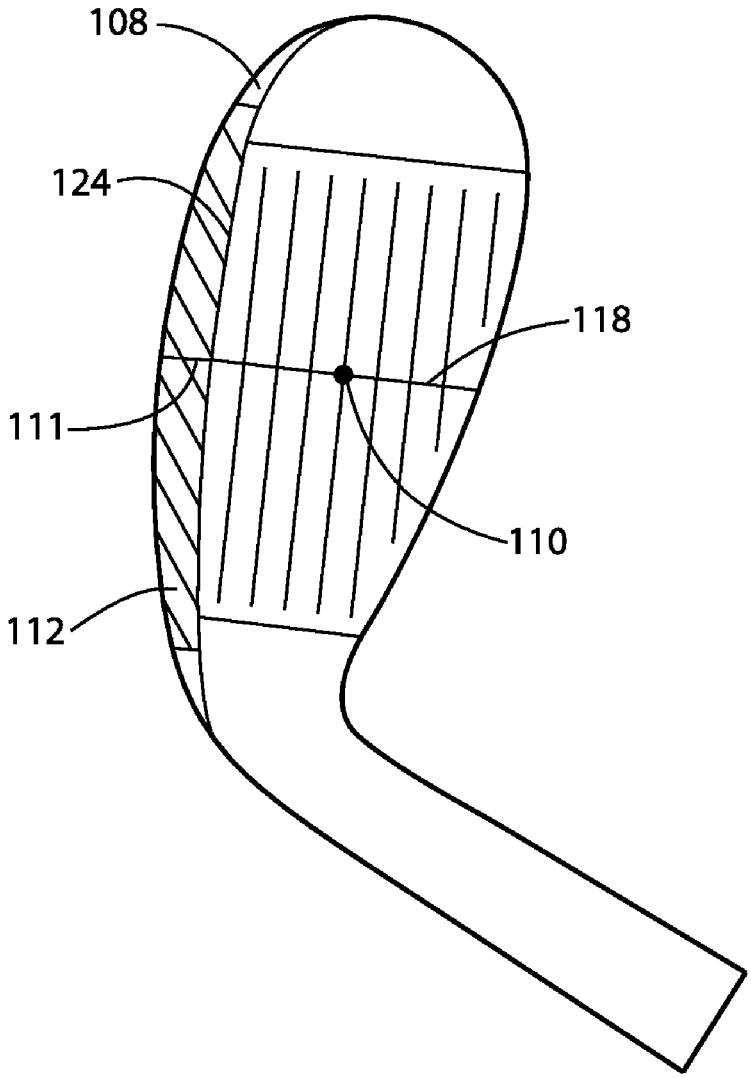
FIG. 3 is a front perspective view of the golf club head of FIG. 1.
Figure 4:
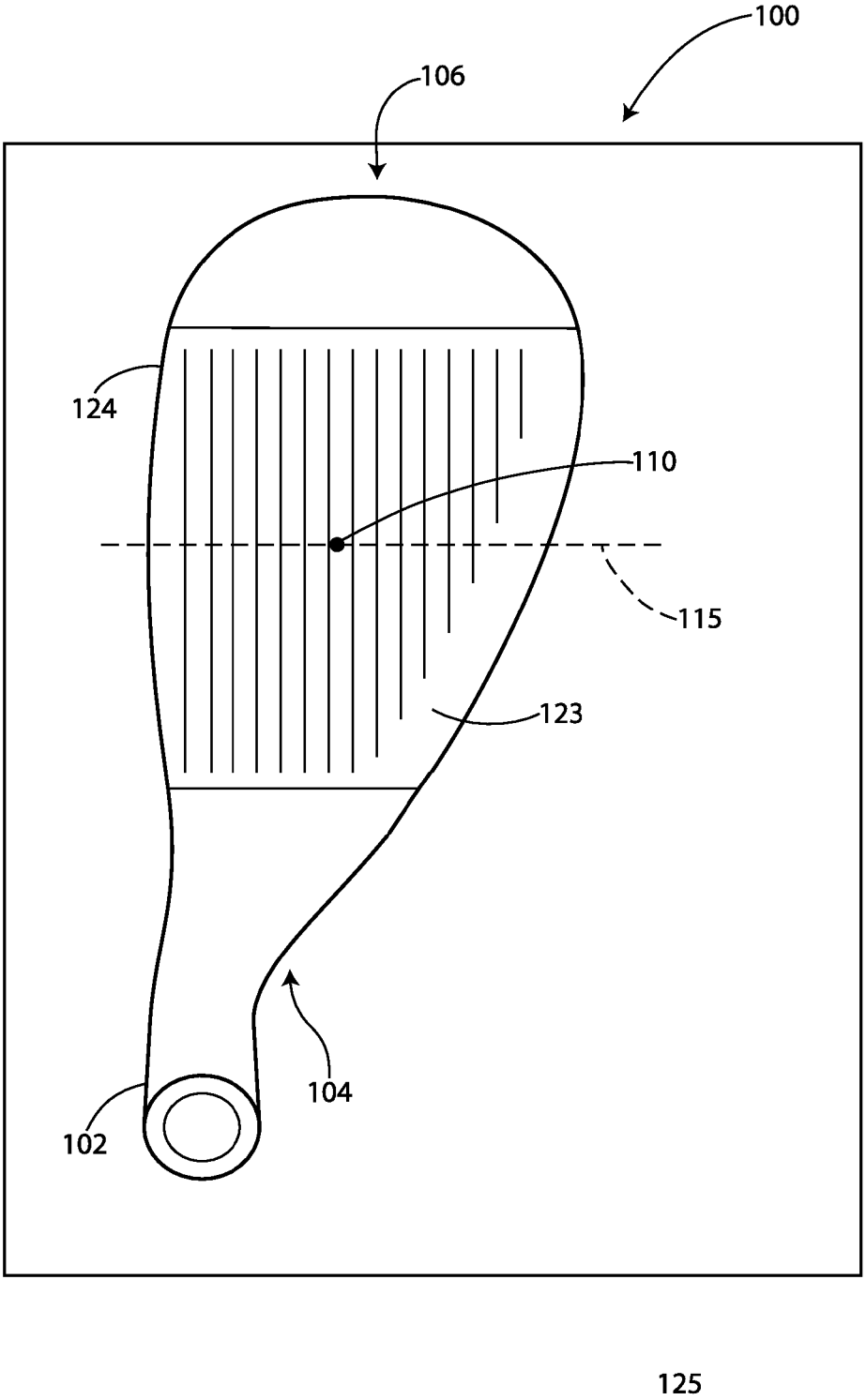
FIG. 4 is a top plan view of the golf club head of FIG. 1.
Figure 5:
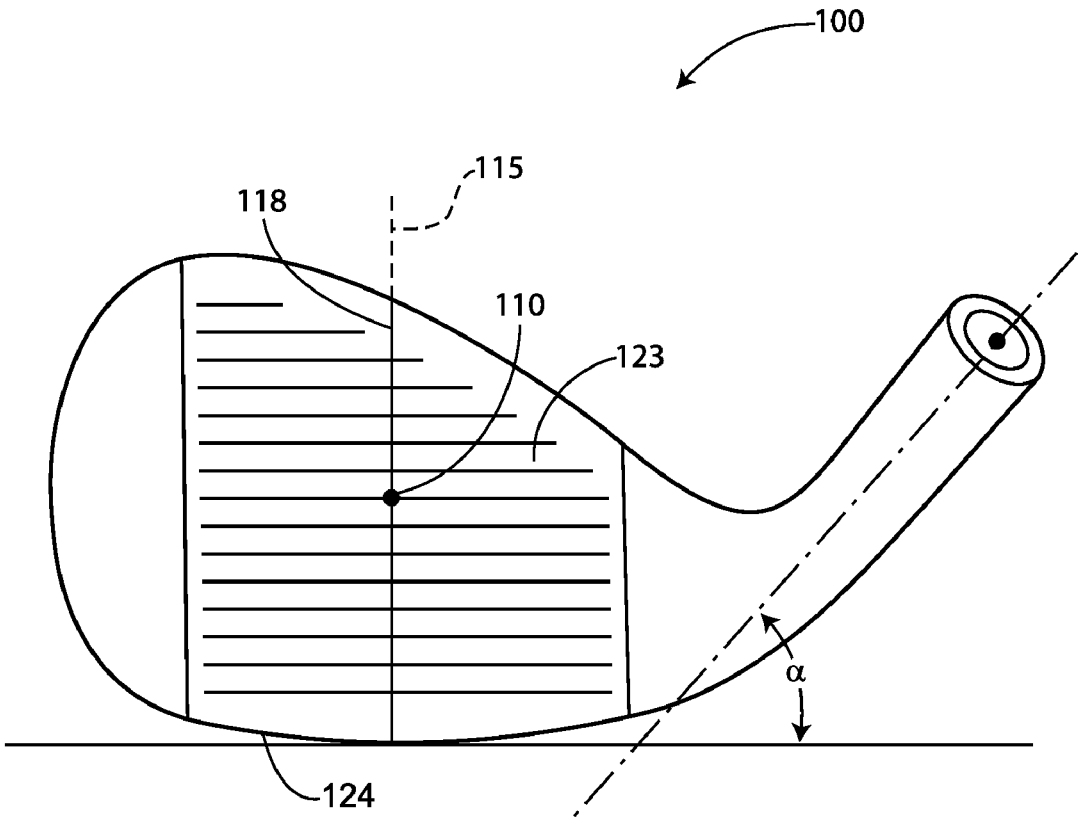
FIG. 5 is a front elevational view of the golf club head of FIG. 1.
Figure 6:
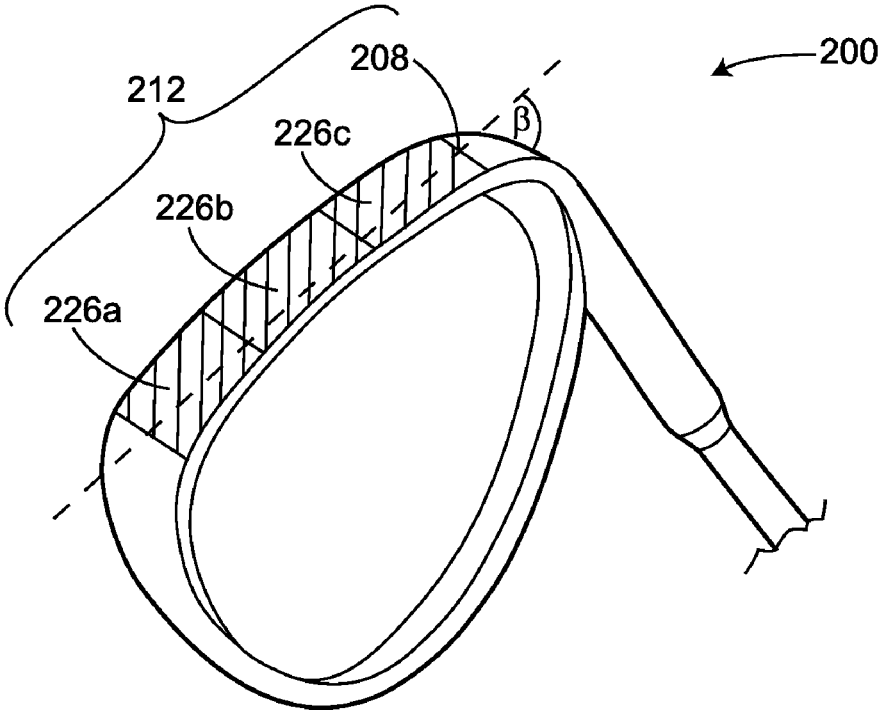
FIG. 6 is a rear perspective view of a golf club head with lie tape applied thereto.

Referring to FIG. 6, the player, according to one or more aspects of the present invention, is initially provided with a test club 200 having a sole 208 and a test lie angle β, measured with the club head in the reference position. A data acquisition device or gauge 212 is applied to the sole 208 of the club head to collect information relating to the player's swing. The gauge 212 may be a mechanical device, e.g., lie tape, or an electronic device that communicates the player's swing information to a data terminal. According to one or more aspects of the present invention, the gauge 212 may comprise a toe region 226*a*, an intermediate region 226*b*, and a heel region 226*c*.

Figure 7:
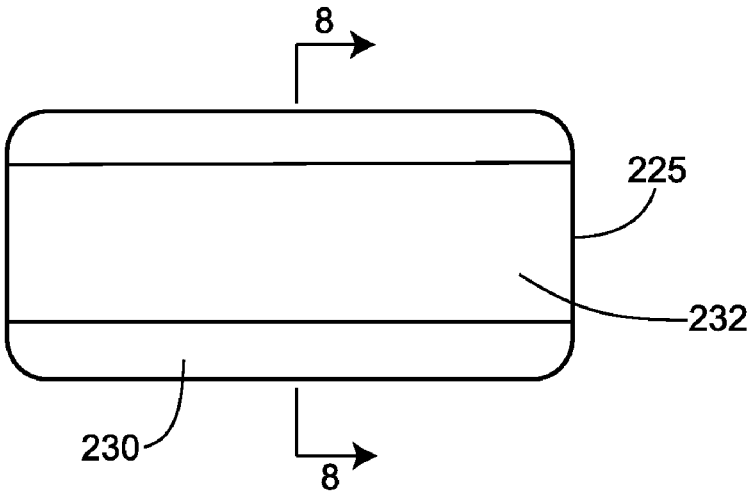
FIG. 7 is a top plan view of a generally planar lie board according to one or more aspects of the present invention.
Figure 8:
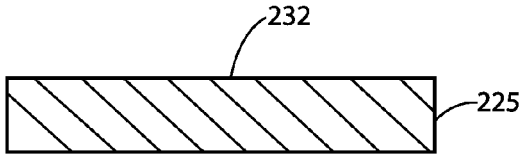
FIG. 8 is a cross-sectional view of the planar lie board of FIG. 7 taken along the lines 8-8 of FIG. 7.
Figure 9A:
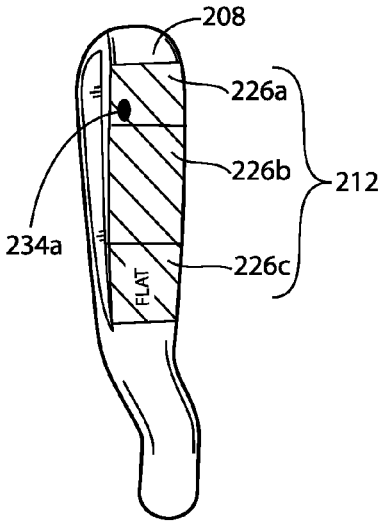
FIG. 9A is a bottom plan view of a golf club head with lie tape applied thereto.
Figure 9B:
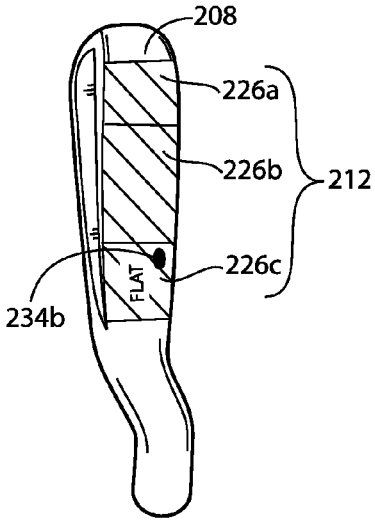
FIG. 9B is a bottom plan view of the golf club head of FIG. 9A.
Figure 9C:
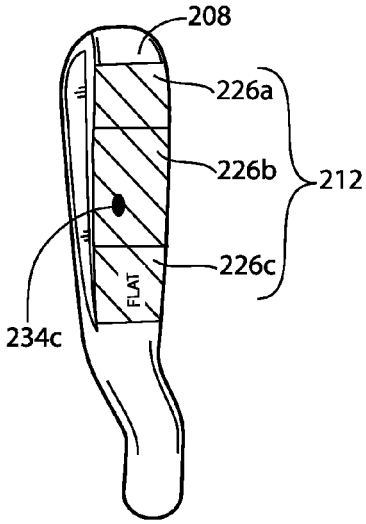
FIG. 9C is a bottom plan view of the golf club head of FIG. 9A.

Referring to FIGS. 7 and 8, the player is directed to swing the test club 200 relative to a primary lie board 225 having a horizontal hitting surface 232, when the lie board 225 is resting on the ground plane for use by the player. As shown in FIGS. 9A-9C, the impact of the gauge 212 against the horizontal hitting surface 232 produces a first witness mark, e.g., first witness marks 234 *a-c*, on the gauge 212. The first witness mark may be formed by the tearing or scarring of the gauge 212 during the test swing or by the transfer of a colored marking directly from the lie board 225 to the gauge 212. In another example, a virtual first witness mark may be transmitted to a data terminal when an electronic gauge is employed. Typically, the primary lie board 225 is formed from a rigid, transparent material, e.g., polycarbonate, polypropylene, plexi-glass, and polytrimethyleneterephthalate (PTT).

Figure 10:
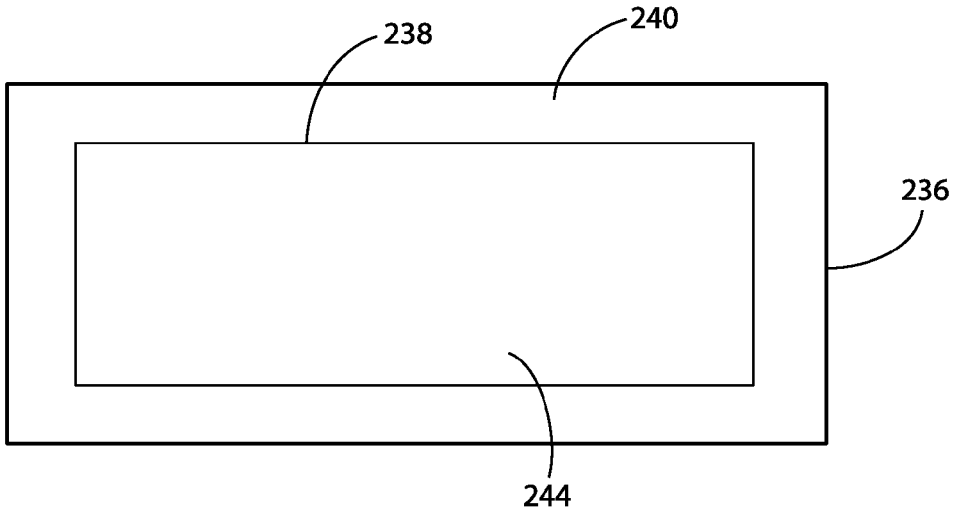
FIG. 10 is a top plan view of an exemplary lie board having an oblique hitting surface according to one or more aspects of the present invention.

After completing the test swing, the location of the first witness mark on the gauge 212 is identified and recorded. For example, the first witness mark may be disposed proximate the toe region 226*a* (FIG. 9A), the intermediate region 226*b* (FIG. 9C), or the heel region 226*c* (FIG. 9B). Referring again to FIG. 9C, if the first witness mark is located proximate the intermediate region 226*b* of the gauge 212, at least one iron-type golf club having a reference lie angle substantially equal to the test lie angle β is selected for the player. For example, if the lie angle of the test club 200 is 62°, then a golf club having a reference lie angle of substantially 62° is selected for the player. The lies of the remaining clubs in the set are adjusted relative to the selected club head. However, if the first witness mark is located proximate the toe region 226*a* (FIG. 9A) or the heel region 226*c* (FIG. 9B), the player is directed to swing the test club 200 relative to a secondary lie board 236 (FIG. 10). Prior to performing a test swing relative to the secondary lie board 236, the gauge 212 may be removed from the sole of the test club and a new gauge may be applied thereto.

Figure 11:
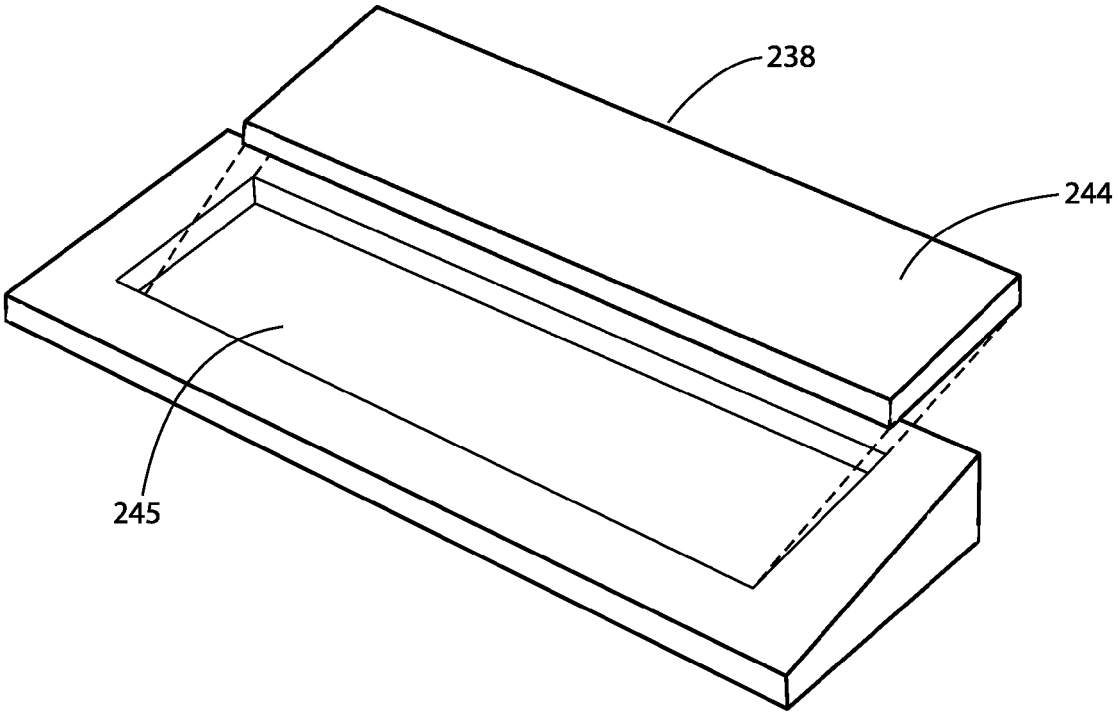
FIG. 11 is an exploded view of the lie board of FIG. 10.

Referring to FIGS. 10 and 11, the secondary lie board 236 may have a two-piece construction comprising a central section 238 and a support structure 240. The central section 238 may have an oblique hitting surface 244 inclined, e.g., 1°, 2°, or 3°, relative to the ground plane, when the lie board 236 is resting on the ground plane for use by the player. Suitable methods for fabricating the secondary lie board 236 may include, e.g., pressure forming, stamping, milling, or water-jetting. Preferably, the secondary lie board 236 may be formed from a light-weight, rigid material, e.g., polycarbonate, polypropylene, PTT, or plexiglass, to minimize the weight of the fitting cart and to facilitate the transport thereof. As shown in FIG. 11, the support structure 240 may include a recess 245 for receiving the central section 238. The central section 238 may be coupled to the support structure 240, e.g., by plastic welding, mechanical interlocking, press fitting, or adhesive bonding. According to one or more aspects of the present invention, the central section 238 of the lie board 236 may be interchangeable, since repeatedly striking the lie board 236 with a test club may accumulate distracting smudges and/or scratches on the hitting surface of the central section 238.

Figure 12:
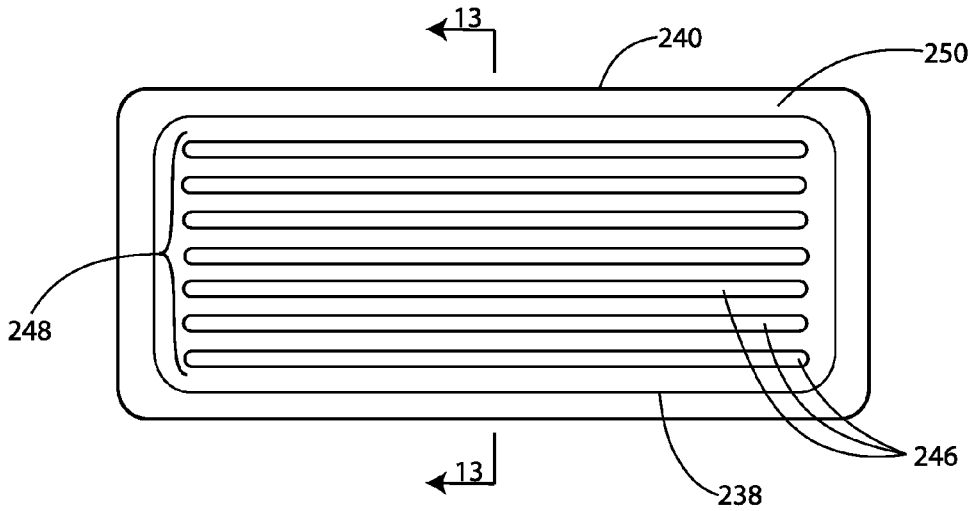
FIG. 12 is a bottom plan view of the lie board of FIG. 10.
Figure 13:
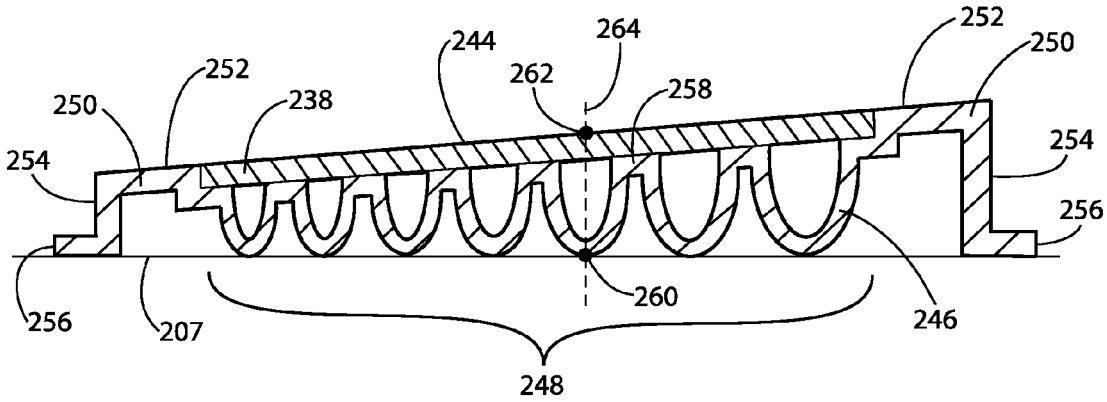
FIG. 13 is a cross-sectional view of the lie board of FIG. 10 taken along the lines 13-13 of FIG. 12.

Referring to FIGS. 12 and 13, the support structure 240 may further include a lateral portion 250 having a lateral surface 252 integral with a support leg 254. Preferably, the secondary lie board 236 is formed from a transparent or translucent material so that decals or indicia applied to the underside of the lateral portion 250 are visible to a player when addressing the secondary lie board 236. The support leg 254 may include a foot 256 that contacts a ground plane 207, when the secondary lie board is resting on the ground plane for use by the player, and provides sufficient torsional resistance to inhibit movement of the board at club impact.

As shown in FIG. 13, the support structure 240 may further include a central reinforcement portion 248 integral with the lateral portion 250 and disposed proximate the central section 238. The central reinforcement portion 248 may include a plurality of longitudinally disposed reinforcement members 246, whereby each reinforcement member may be separated by a support platform 258 that abuts the central section 238 to help prevent impact and/or fatigue cracking thereof. Moreover, each reinforcement member 246 may at least partially contact the ground plane 207, when the secondary lie board 236 is resting on the ground plane for use by the player, to minimize the deflection of the central section 238 at club impact. Deflection of the central section 238 during a test swing may lead to inaccurate test results. To accommodate the changes in elevation associated with the inclined lie board 236, each reinforcement member 246 may have a distinct effective height. "Effective height", as used herein, denotes a vertical distance between a first point 260, characterized as a point of contact between a reinforcement member 246 and the ground plane 207, and a second point 262, characterized by the intersection of an imaginary line 264, substantially perpendicular to the ground plane and containing the first point 260, with the hitting surface 244. The effective heights of the reinforcement members may range between about 0.10 inches and about 1 inch and more preferably between about 0.25 inches and about 0.50 inches.

Figure 14:
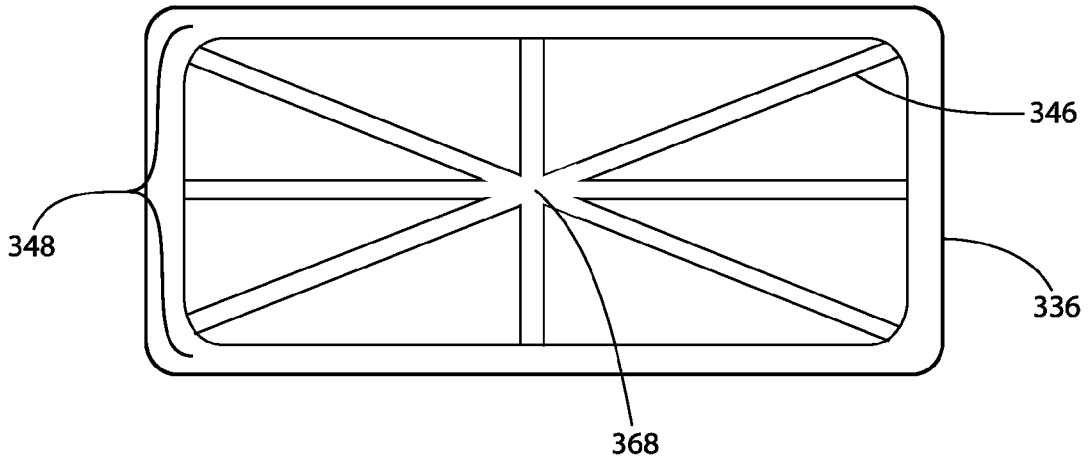
FIG. 14 is a bottom plan view of an exemplary lie board according to one or more aspects of the present invention.
Figure 15:
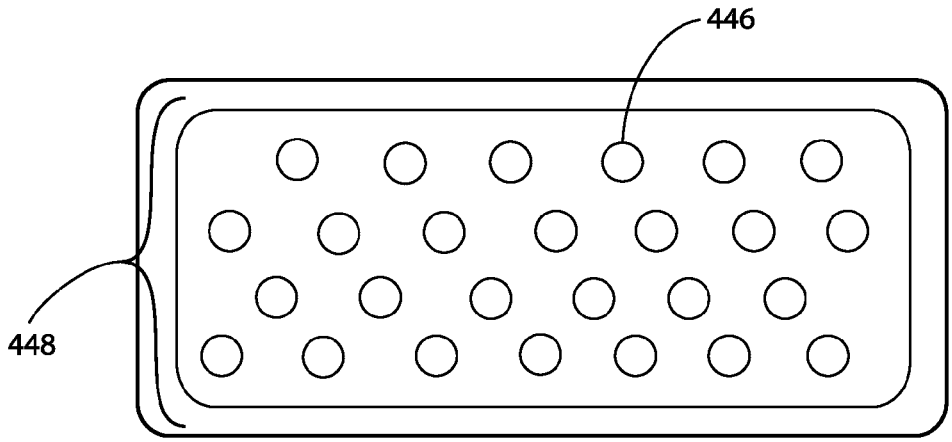
FIG. 15 is a bottom plan view of an exemplary lie board according to one or more aspects of the present invention.
Figure 16:
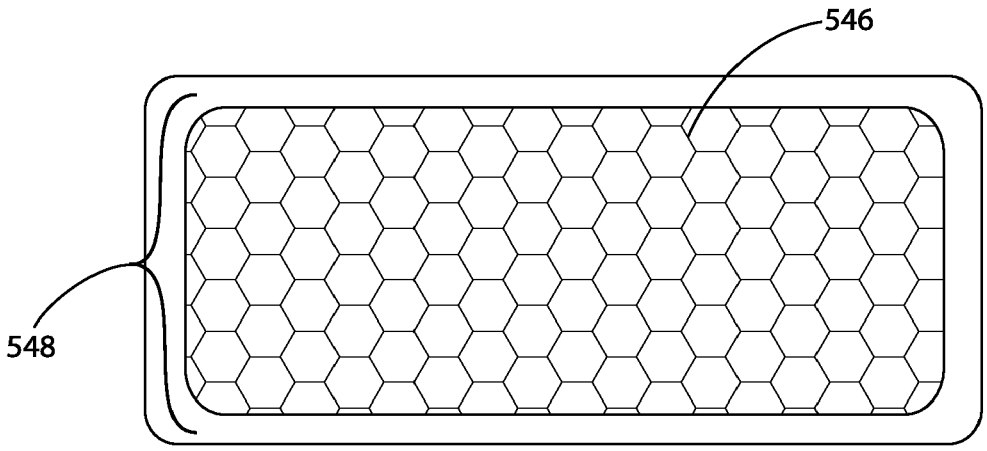
FIG. 16 is a bottom plan view of an exemplary lie board according to one or more aspects of the present invention.
Figure 17:
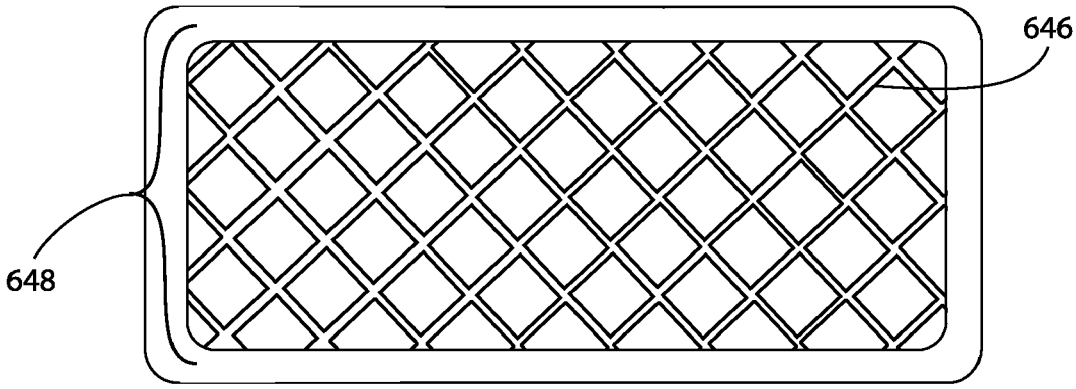
FIG. 17 is a bottom plan view of an exemplary lie board according to one or more aspects of the present invention.
Figure 18:
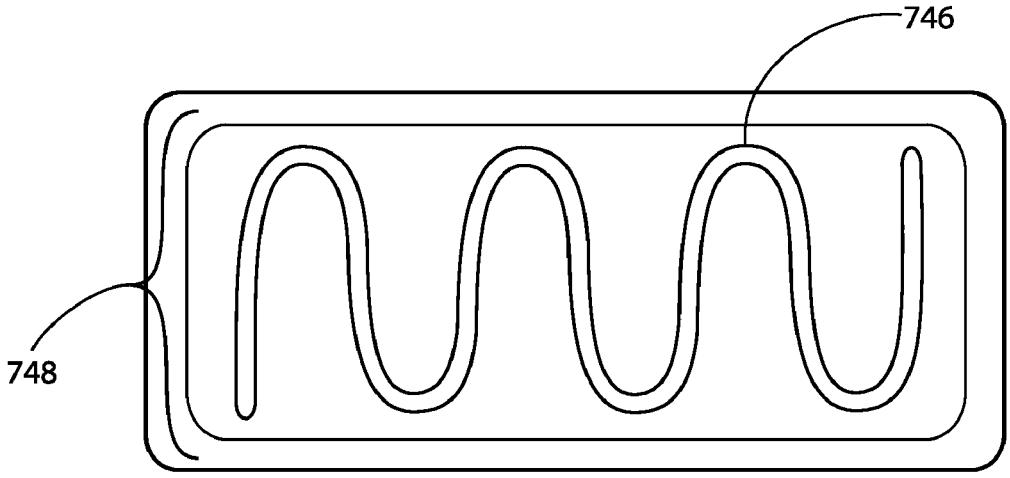
FIG. 18 is a bottom plan view of an exemplary lie board according to one or more aspects of the present invention.
Figure 19:
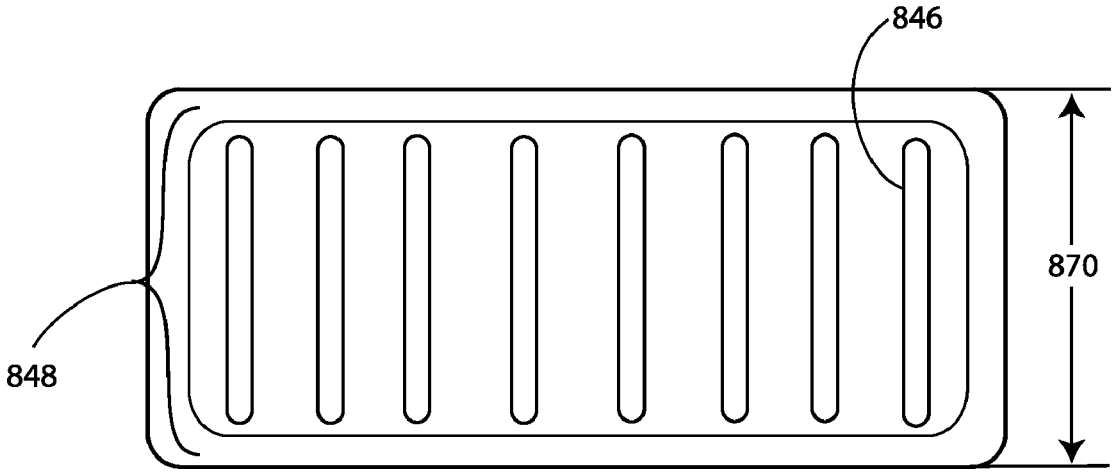
FIG. 19 is a bottom plan view of an exemplary lie board according to one or more aspects of the present invention.

As illustrated in FIGS. 14-19, the orientation of the reinforcement members relative to the central reinforcement portion may vary. For example, as shown in FIG. 14, a secondary lie board 336 may include a central reinforcement portion 348 having a plurality of reinforcement members 346 that originate from a central location 368. At least two reinforcement members 346 are disposed diagonally across the central reinforcement portion 348 and at least two reinforcement members 346 are oriented perpendicular to one another. In another example, shown in FIG. 15, a secondary lie board 436 may include a central reinforcement portion 448 comprising a plurality of circular-shaped reinforcement members 446. FIG. 16 depicts a secondary lie board 536 having a central reinforcement portion 548 comprising a plurality of reinforcement members 546 oriented in a honey-comb shaped structure. Alternatively, FIG. 17 illustrates a secondary lie board 636 comprising a reinforcement portion 648 having a plurality of reinforcement members 646 arranged in a waffle pattern. In another example, shown in FIG. 18, a secondary lie board 736 may have a central reinforcement portion 748 comprising a single, curvilinear reinforcement member 746. In yet another example, shown in FIG. 19, a secondary lie board 836 may have a central reinforcement portion 848 including a plurality of reinforcement members 846, whereby each reinforcement member 846 is disposed parallel to the transverse dimension 870.

Figure 20:
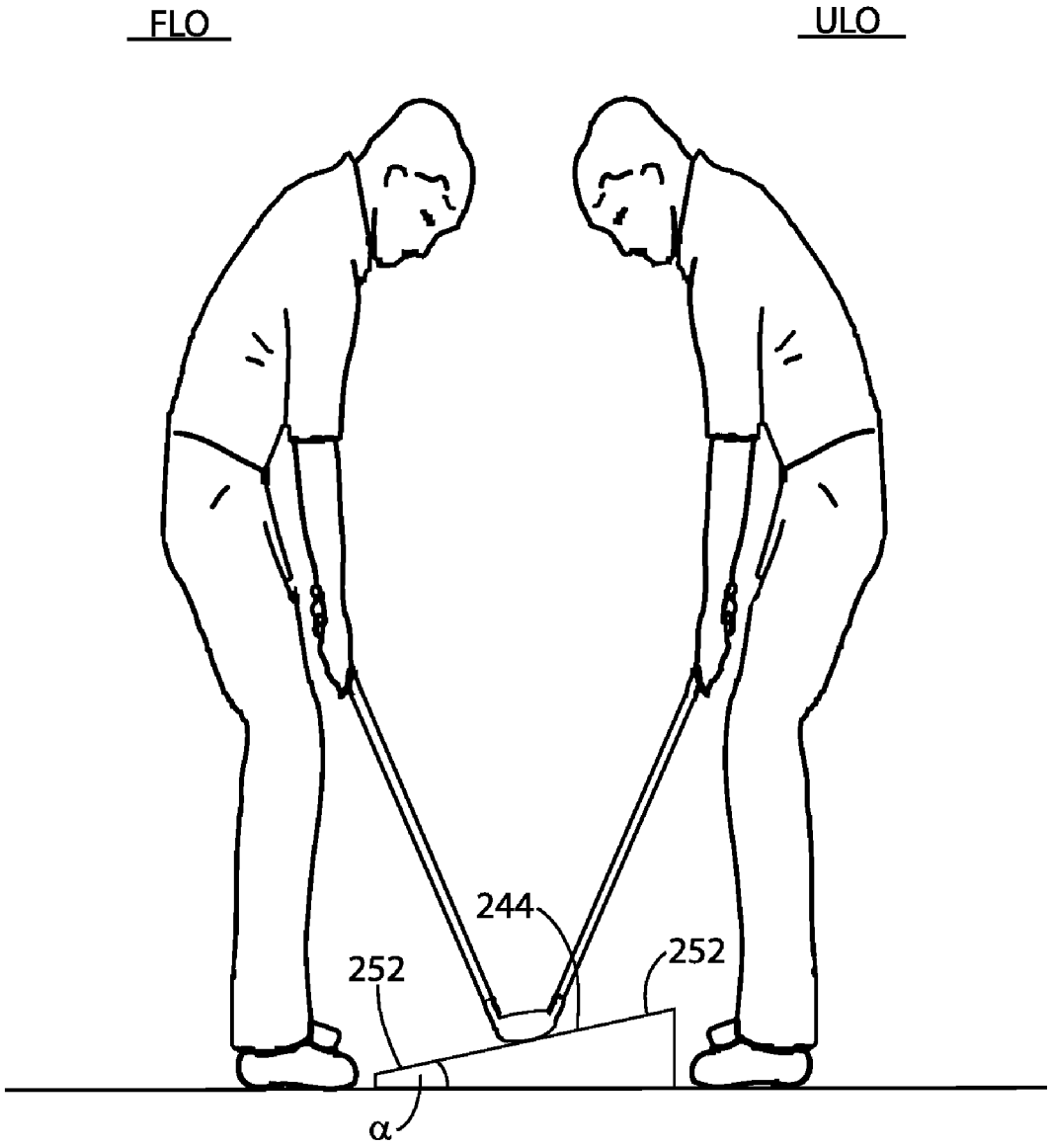
FIG. 20 illustrates a golfer addressing a lie board having an oblique hitting surface.

Referring again to FIG. 9A, if the first witness mark, e.g., the first witness mark 234*a*, is proximate the toe region 226*a*, the player is directed to swing the test club 200 relative to the secondary lie board 236, with the secondary lie board 236 in an upright lie-angle orientation relative to the player. As shown in FIG. 20, the secondary lie board 236 is in the upright lie-angle orientation ULO when the player is addressing the oblique hitting surface 244 with his or her feet perpendicular to and proximate the highest edge of the lateral surface 252. Prior to performing the upright lie-angle test swing relative to the secondary lie board 236, each region of the gauge 212 (see FIG. 6) may be assigned a distinct upright lie-angle value. For example, the toe region 226*a* may be associated with a first upright lie-angle value, e.g., 3°, the intermediate region 226*b* may be associated with a second upright lie-angle value, e.g., 2°, and the heel region 226*e* may be associated with a third upright lie-angle value, e.g., 1°.

Figure 21A:
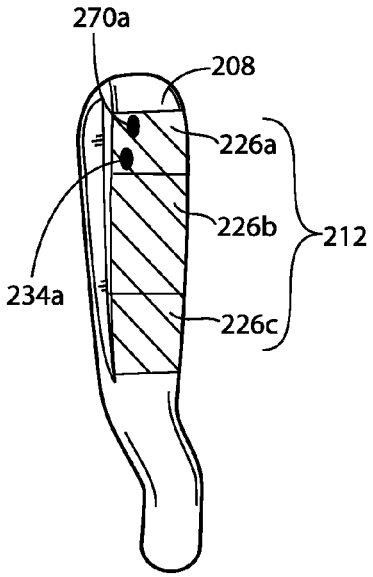
FIG. 21A is a bottom plan view of a golf club head with lie tape applied thereto.
Figure 21B:
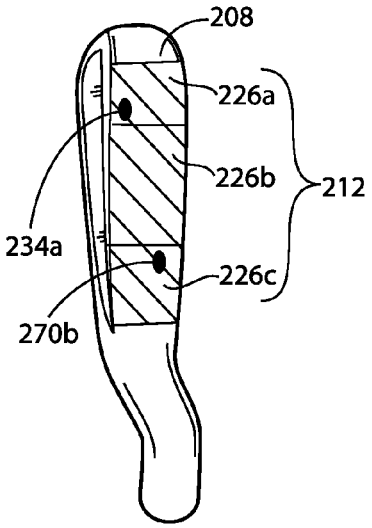
FIG. 21B is a bottom plan view of the golf club head of FIG. 21A.
Figure 21C:
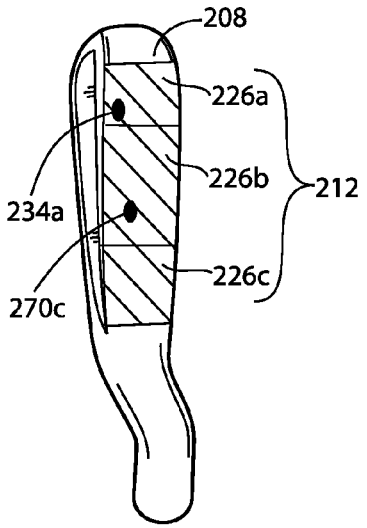
FIG. 21C is a bottom plan view of the golf club head of FIG. 21A.

During the upright lie-angle test swing, the impact of the gauge 212 against the oblique hitting surface 244 produces a second witness mark on the gauge 212. Referring to FIG. 21A, if the second witness mark, e.g., the second witness mark 270*a*, is proximate the toe region 226*a*, at least one iron-type golf club having a reference lie-angle that is substantially equal to the sum of the test lie angle β (see FIG. 6) and the first upright lie-angle value is selected for the player. Referring to FIG. 21B, if the second witness mark, e.g., the second witness mark 270*b*, is proximate the heel region 226*c*, at least one iron-type golf club having a reference lie-angle that is substantially equal to the sum of the test lie angle β and the third upright lie-angle value is selected for the player. Referring to FIG. 21C, if the second witness mark, e.g., the second witness mark 270*c*, is proximate the intermediate region 226*b*, at least one iron-type golf club having a reference lie-angle that is substantially equal to the sum of the test lie angle β and the second upright-lie angle value is selected for the player.

Referring again to FIG. 9B, if the first witness mark, e.g., the first witness mark 234*b*, is proximate the heel region 226*c*, the player is directed to swing the test club 200 relative to the secondary lie board 236, with the secondary lie board 236 in a flat lie-angle orientation relative to the player. As shown in FIG. 20, the secondary lie board 236 is in the flat lie-angle orientation FLO when the player is addressing the oblique hitting surface 244 with his or her feet perpendicular to and proximate the lowest edge of the lateral surface 252. Prior to performing the flat lie-angle test swing relative to the secondary lie board 236, each region of the gauge 212 may be assigned a distinct flat lie-angle value. For example, the toe region 226*a* may be associated with a first flat lie-angle value, e.g., 1°, the intermediate region 226*b* may be associated with a second flat lie-angle value, e.g., 2°, and the heel region 226*c* may be associated with a third flat lie-angle value, e.g., 3°.

Figure 22A:
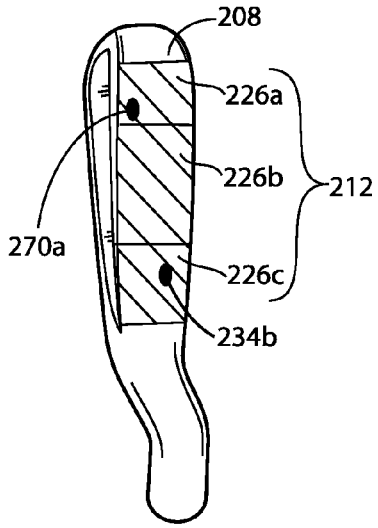
FIG. 22A is a bottom plan view of the golf club head of FIG. 21A.
Figure 22B:
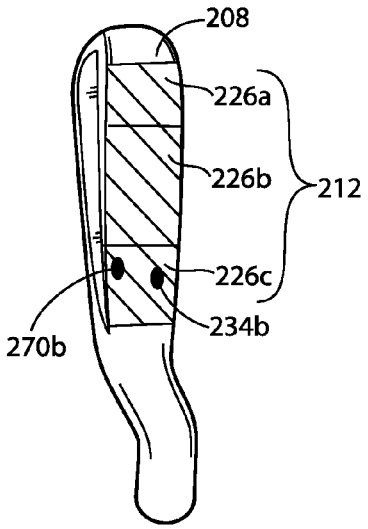
FIG. 22C is a bottom plan view of the golf club head of FIG. 21A.
Figure 22C:
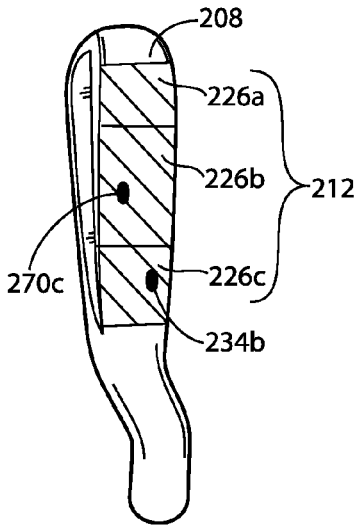

During the flat lie-angle test swing, the impact of the gauge 212 against the oblique hitting surface 244 produces a second witness mark on the gauge 212. Referring to FIG. 22A, if the second witness mark, e.g., the second witness mark 270*a*, is proximate the toe region 226*a*, at least one iron-type golf club having a reference lie-angle that is substantially equal to the difference between the test lie angle β and the first flat lie-angle value is selected for the player. Referring to FIG. 22B, if the second witness mark, e.g., the second witness mark 270*b*, is proximate the heel region 226*c*, at least one iron-type golf club having a reference lie-angle that is substantially equal to the difference between the test lie angle β and the third flat lie-angle value is selected for the player. Referring to FIG. 22C, if the second witness mark, e.g., the second witness mark 270*c*, is proximate the intermediate region 226*b*, at least one iron-type golf club having a reference lie-angle that is substantially equal to the difference between the test lie angle β and the second flat-lie angle value is selected for the player.

Figure 23A:
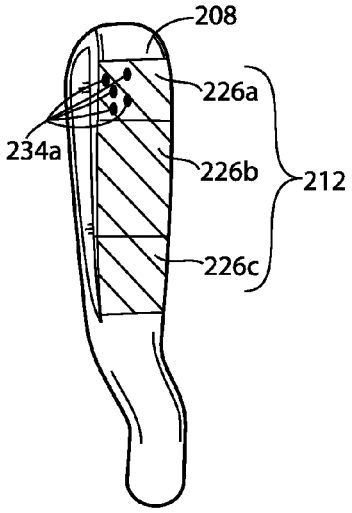
FIG. 23A is a bottom plan view of the golf club head of FIG. 21A.
Figure 23B:
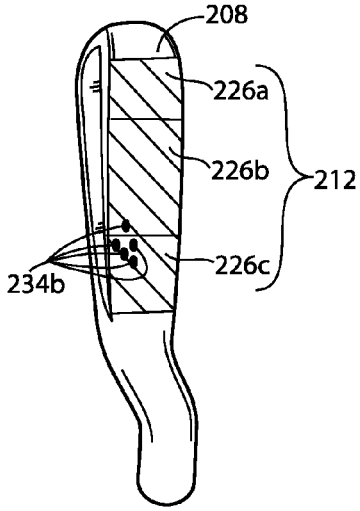
FIG. 23B is a bottom plan view of the golf club head of FIG. 21A.
Figure 23C:
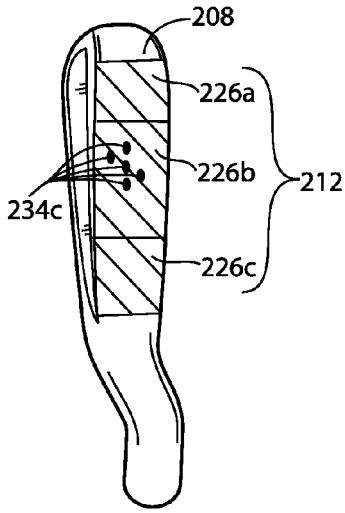
FIG. 23C is a bottom plan view of the golf club head of FIG. 21A.

Since the impact location between the sole of the test club and the lie board can vary for each swing, the player may be directed to perform a plurality of test swings relative to the primary lie board 225 (FIG. 7) and the secondary lie board 236 (FIG. 11) to accurately determine the player's swing tendencies. For example, the player may be directed to perform at least two test swings relative to the horizontal hitting surface 232 of the primary lie board 225 to produce at least two first witness marks on the gauge 212. Referring to FIG. 23C, if the majority of the at least two first witness marks 234*c* is located proximate the intermediate region 226*b*, at least one iron-type golf club having a reference lie angle substantially equal to the test lie angle β is selected for the player. However, if the majority of the at least two first witness marks 234*a* is located proximate the toe region 226*a* (FIG. 23A) or the heel region 226*b* (FIG. 23B), the player is directed to perform at least two test swings relative to the secondary lie board 236. Prior to performing a test swing relative to the secondary lie board 236, the gauge 212 may be removed from the sole of the test club and a new gauge may be applied thereto.

Referring again to FIG. 23A, if the majority of the first witness marks, e.g., first witness marks 234*a*, is proximate the toe region 226*a*, the player is directed to perform a plurality of test swings relative to the secondary lie board 236, with the secondary lie board 236 (FIG. 11) in the upright lie-angle orientation relative to the player. Each impact of the gauge 212 against the oblique hitting surface of the secondary lie board produces a second witness mark proximate the toe region 226*a*, the intermediate region 226*b*, or the heel region 226*c*.

Figure 24A:
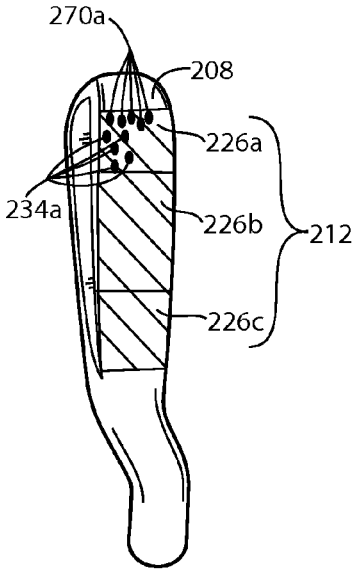
FIG. 24A is a bottom plan view of the golf club head of FIG. 21A.
Figure 24B:
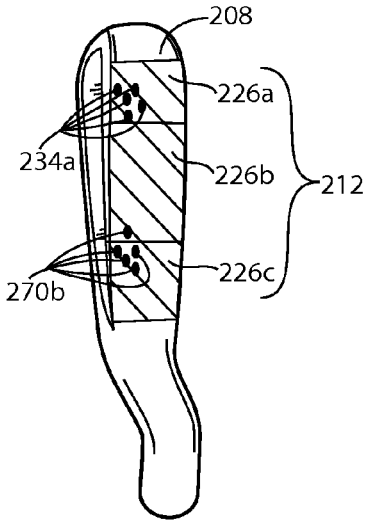
FIG. 24B is a bottom plan view of the golf club head of FIG. 21A.
Figure 24C:
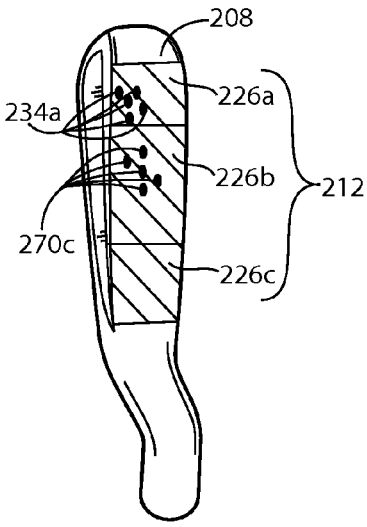
FIG. 24C is a bottom plan view of the golf club head of FIG. 21A.

If the majority of the at least two second witness marks 270*a* is proximate the toe region 226*a* (FIG. 24A), at least one iron-type golf club having a reference lie-angle that is substantially equal to the sum of the test lie angle β and the first upright lie-angle value is selected for the player. Alternatively, if the majority of the at least two second witness marks 270*b* is proximate the heel region 226*c* (FIG. 24B), at least one iron-type golf club having a reference lie-angle that is substantially equal to the sum of the test lie angle β and the third upright lie-angle value is selected for the player. Moreover, if the majority of the at least two second witness marks 270*c* is proximate the intermediate region 226*b* (FIG. 24C), at least one iron-type golf club having a reference lie-angle that is substantially equal to the sum of the test lie angle β and the second upright-lie angle value is selected for the player.

Referring again to FIG. 23B, if the majority of the first witness marks, e.g., the first witness mark 234*b*, is proximate the heel region 226*a*, the player is directed to perform a plurality of test swings relative to the secondary lie board 236, with the secondary lie board 236 in the flat lie-angle orientation relative to the player. Each impact of the gauge 212 against the oblique hitting surface 244 produces a second witness mark proximate either the toe region 226*a*, the intermediate region 226*b*, or the heel region 226*c*.

Figure 25A:
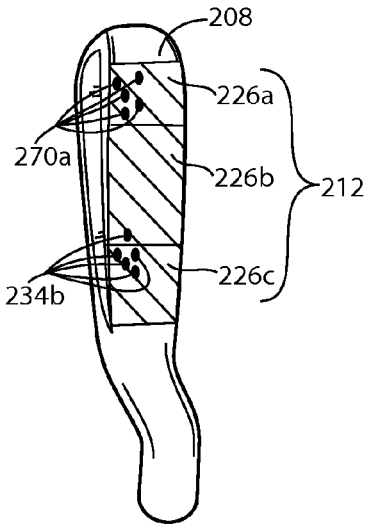
FIG. 25A is a bottom plan view of the golf club head of FIG. 21A.
Figure 25B:
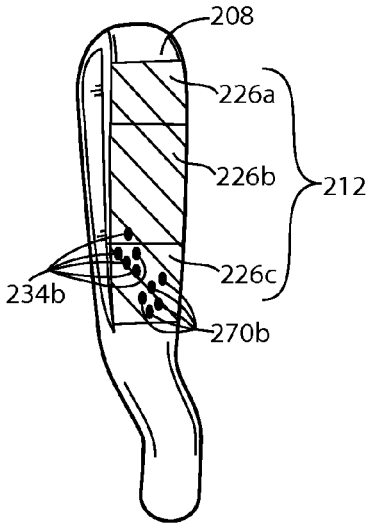
FIG. 25B is a bottom plan view of the golf club head of FIG. 21A.
Figure 25C:
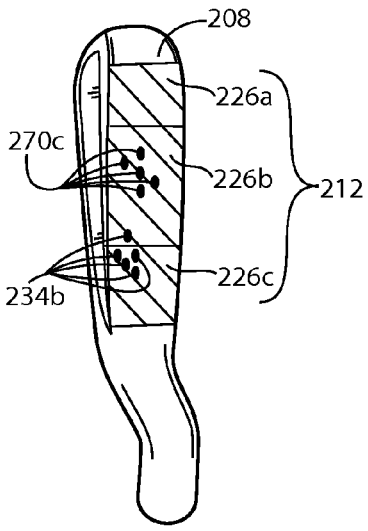
FIG. 25C is a bottom plan view of the golf club head of FIG. 21A.

If the majority of the second witness marks is proximate the toe region 226*a* (FIG. 25A), at least one iron-type golf club having a reference lie-angle that is substantially equal to the difference between the test lie angle β and the first flat lie-angle value is selected for the player. Conversely, if the majority of the at least two second witness marks is proximate the heel region 226*c* (FIG. 25B), at least one iron-type golf club having a reference lie-angle that is substantially equal to the difference between the test lie angle β and the third flat lie-angle value is selected for the player. Moreover, if the majority of the at least two second witness marks is proximate the intermediate region 226*b* (FIG. 25C), at least one iron-type golf club having a reference lie-angle that is substantially equal to the difference between the test lie angle β and the second flat-lie angle value is selected for the player.

According to one or more aspects of the present invention, the reference lie angle may be determined without using a lie board. For example, the player may be directed to perform test swings relative to any horizontal surface, e.g., a hitting mat. Moreover, one or more oblique hitting surfaces may be provided in lieu of the secondary lie board, described above. In yet another aspect, the present invention may include a golf club and/or a golf club set which has been custom fitted to a particular person using any of the methods set forth herein.

In the foregoing specification, the invention has been described with reference to specific exemplary aspects thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

The invention claimed is:

1. A method of determining a reference lie angle for at least one iron-type golf club custom-fit for a player, the method comprising:

a) providing a primary lie board having a horizontal hitting surface;

b) providing a secondary lie board having an oblique hitting surface inclined relative to the horizontal surface, the secondary lie board comprising a flat lie-angle orientation and an upright lie-angle orientation;

c) providing a test club comprising a sole and a test lie angle, the test club having a predetermined relationship with the at least one iron-type golf club;

d) providing a gauge comprising a toe region, a heel region, and an intermediate region;

e) applying the gauge to the sole of the test club;

f) directing the player to swing the test club relative to the horizontal hitting surface to impact the gauge against the horizontal hitting surface, whereby a first witness mark is produced on the gauge;

g) identifying whether the first witness mark is proximate the toe region, the heel region, or the intermediate region;

h) if the first witness mark is proximate the intermediate region, selecting the at least one iron-type golf club wherein the reference lie angle is substantially equal to the test lie angle;

i) if the first witness mark is proximate the heel region, directing the player to swing the test club relative to the oblique hitting surface, with the secondary lie board in the flat lie-angle orientation, to impact the gauge against the oblique hitting surface, whereby a second witness mark is produced on the gauge;

j) identifying whether the second witness mark of step (i) is proximate the toe region, the heel region, or the intermediate region, the toe region associated with a first flat lie-angle value, the intermediate region associated with a second flat lie-angle value, and the heel region associated with a third flat lie-angle value;

k) if the second witness mark of step (i) is proximate the toe region, selecting the at least one iron-type golf club wherein the reference lie angle is substantially equal to the difference between the test lie angle and the first flat lie-angle value;

l) if the second witness mark of step (i) is proximate the intermediate region, selecting the at least one iron-type golf club wherein the reference lie angle is substantially equal to the difference between the test lie angle and the second flat lie-angle value;

m) if the second witness mark of step (i) is proximate the heel region, selecting the at least one iron-type golf club wherein the reference lie angle is substantially equal to the difference between the test lie angle and the third flat lie-angle value;

n) if the first witness mark is proximate the toe region, directing the player to swing the test club off the oblique hitting surface, with the secondary lie board in the upright lie-angle orientation, to impact the gauge against the oblique hitting surface, whereby the second witness mark is produced on the gauge;

o) identifying whether the second witness mark of step (n) is proximate the toe region, the heel region, or the intermediate region, the toe region associated with a first upright lie-angle value, the intermediate region associated with a second upright lie-angle value, and the heel region associated with a third upright lie-angle value;

p) if the second witness mark of step (n) is proximate the toe region, selecting the at least one iron-type golf club wherein the reference lie angle is substantially equal to the sum of the test lie angle and the first upright lie-angle value;

q) if the second witness mark of step (n) is proximate the intermediate region, selecting the at least one iron-type golf club wherein the reference lie angle is substantially equal to the sum of the test lie angle and the second upright lie-angle value; and r) if the second witness mark of step (n) is proximate the heel region, selecting the at least one iron-type golf club wherein the reference lie angle is substantially equal to the sum of the test lie angle and the third upright lie-angle value.

2. A method of determining a reference lie angle for at least one iron-type golf club custom-fit for a player, the method comprising:

a) providing a horizontal hitting surface;

b) providing an oblique hitting surface inclined relative to the horizontal surface, the oblique hitting surface comprising a flat lie-angle orientation and an upright lie-angle orientation;

c) providing a test club comprising a sole and a test lie angle, the test club having a predetermined relationship with the at least one iron-type golf club;

d) providing a gauge comprising a toe region, a heel region, and a intermediate region;

e) applying the gauge to the sole of the test club;

f) directing the player to swing the test club relative to the horizontal hitting surface to impact the gauge against the horizontal hitting surface, whereby a first witness mark is produced on the gauge;

g) identifying whether the first witness mark is proximate the toe region, the heel region, or the intermediate region;

h) if the first witness mark is proximate the intermediate region, selecting the at least one iron-type golf club wherein the reference lie angle is substantially equal to the test lie angle;

i) if the first witness mark is proximate the heel region, directing the player to swing the test club relative to the oblique hitting surface, with the oblique hitting surface in the flat lie-angle orientation, to impact the gauge against the oblique hitting surface, whereby a second witness mark is produced on the gauge;

j) identifying whether the second witness mark of step (i) is proximate the toe region, the heel region, or the intermediate region, the toe region associated with a first flat lie-angle value, the intermediate region associated with a second flat lie-angle value, and the heel region associated with a third flat lie-angle value;

k) if the second witness mark of step (i) is proximate the toe region, selecting the at least one iron-type golf club wherein the reference lie angle is substantially equal to the difference between the test lie angle and the first flat lie-angle value;

l) if the second witness mark of step (i) is proximate the intermediate region, selecting the at least one iron-type golf club wherein the reference lie angle is substantially equal to the difference between the lie angle and the second flat lie-angle value;

m) if the second witness mark of step (i) is proximate the heel region, selecting the at least one iron-type golf club wherein the reference lie angle is substantially equal to the difference between the test lie angle and the third flat lie-angle value;

n) if the first witness mark is proximate the toe region, directing the player to swing the test club relative to the oblique hitting surface, with the oblique hitting surface in the upright lie-angle orientation, to impact the gauge against the oblique hitting surface, whereby the second witness mark is produced on the gauge;

o) identifying whether the second witness mark of step (n) is proximate the toe region, the heel region, or the intermediate region, the toe region associated with a first upright lie-angle value, the intermediate region associated with a second upright lie-angle value, and the heel region associated with a third upright lie-angle value;

p) if the second witness mark of step (n) is proximate the toe region, selecting the at least one iron-type golf club wherein the reference lie angle is substantially equal to the sum of the test lie angle and the first upright lie-angle value;

q) if the second witness mark of step (n) is proximate the intermediate region, selecting the at least one iron-type golf club wherein the reference lie angle is substantially equal to the sum of the test lie angle and the second upright lie-angle value; and r) if the second witness mark of step (n) is proximate the heel region, selecting the at least one iron-type golf club wherein the reference lie angle is substantially equal to the sum of the test lie angle and the third upright lie-angle value.

3. A method of determining a reference lie angle for at least one iron-type golf club custom-fit for a player, the method comprising:

a) providing a horizontal hitting surface;

b) providing an oblique hitting surface inclined relative to the horizontal surface, the oblique hitting surface comprising a flat lie-angle orientation and an upright lie-angle orientation;

c) providing a test club comprising a sole and a test lie angle, the test club having a predetermined relationship with the at least one iron-type golf club;

d) providing a first gauge and a second gauge, each comprising a toe region, a heel region, and a intermediate region;

e) applying the first gauge to the sole of the test club;

f) directing the player to swing the test club relative to the horizontal hitting surface to impact the first gauge against the horizontal hitting surface, whereby a first witness mark is produced on the first gauge;

g) identifying whether the first witness mark is proximate the toe region, the heel region, or the intermediate region;

h) if the first witness mark is proximate the intermediate region, selecting the at least one iron-type golf club wherein the reference lie angle is substantially equal to the test lie angle;

i) if the first witness mark is proximate the heel region, removing the first gauge from the sole of the test club, applying the second gauge to the sole of the test club, directing the player to swing the test club relative to the oblique hitting surface, with the oblique hitting surface in the flat lie-angle orientation, to impact the second gauge against the oblique hitting surface, whereby a second witness mark is produced on the second gauge;

j) identifying whether the second witness mark of step (i) is proximate the toe region, the heel region, or the intermediate region, the toe region associated with a first flat lie-angle value, the intermediate region associated with a second flat lie-angle value, and the heel region associated with a third flat lie-angle value;

k) if the second witness mark of step (i) is proximate the toe region, selecting the at least one iron-type golf club wherein the reference lie angle is substantially equal to the difference between the test lie angle and the first flat lie-angle value;

l) if the second witness mark of step (i) is proximate the intermediate region, selecting the at least one iron-type golf club wherein the reference lie angle is substantially equal to the difference between the test lie angle and the second flat lie-angle value;

m) if the second witness mark of step (i) is proximate the heel region, selecting the at least one iron-type golf club wherein the reference lie angle is substantially equal to the difference between the test lie angle and the third flat lie-angle value;

n) if the first witness mark is proximate the toe region, removing the first gauge from the sole of the test club, applying the second gauge to the sole of the test club, directing the player to swing the test club relative to the oblique hitting surface, with the oblique hitting surface in the upright lie-angle orientation, to impact the second gauge against the oblique hitting surface, whereby the second witness mark is produced on the second gauge;

o) identifying whether the second witness mark of step (n) is proximate the toe region, the heel region, or the intermediate region, the toe region associated with a first upright lie-angle value, the intermediate region associated with a second upright lie-angle value, and the heel region associated with a third upright lie-angle value;

p) if the second witness mark of step (n) is proximate the toe region, selecting the at least one iron-type golf club wherein the reference lie angle is substantially equal to the sum of the test lie angle and the first upright lie-angle value;

q) if the second witness mark of step (n) is proximate the intermediate region, selecting the at least one iron-type golf club wherein the reference lie angle is substantially equal to the sum of the test lie angle and the second upright lie-angle value; and r) if the second witness mark of step (n) is proximate the heel region, selecting the at least one iron-type golf club wherein the reference lie angle is substantially equal to the sum of the test lie angle and the third upright lie-angle value.

4. A method of determining a reference lie angle for at least one iron-type golf club custom-fit for a player, the method comprising:

a) providing a horizontal hitting surface;

b) providing an oblique hitting surface inclined relative to the horizontal surface, the oblique hitting surface comprising a flat lie-angle orientation and an upright lie-angle orientation;

c) providing a test club comprising a sole and a test lie angle, the test club having a predetermined relationship with the at least one iron-type golf club;

d) providing a gauge comprising a toe region, a heel region, and a intermediate region;

e) applying the gauge to the sole of the test club;

f) directing the player to perform at least two test swings relative to the horizontal hitting surface to impact the gauge against the horizontal hitting surface, whereby at least two first witness marks are produced on the gauge;

g) identifying whether a majority of the at least two first witness marks is proximate the toe region, the heel region, or the intermediate region;

h) if the majority of the at least two first witness marks is proximate the intermediate region, selecting the at least one iron-type golf club wherein the reference lie angle is substantially equal to the test lie angle;

i) if the majority of the at least two first witness marks is proximate the heel region, directing the player to perform at least two test swings relative to the oblique hitting surface, with the oblique hitting surface in the flat lie-angle orientation, to impact the gauge against the oblique hitting surface, whereby at least two second witness marks are produced on the gauge;

j) identifying whether a majority of the at least two second witness marks of step (i) is proximate the toe region, the heel region, or the intermediate region, the toe region associated with a first flat lie-angle value, the intermediate region associated with a second flat lie-angle value, and the heel region associated with a third flat lie-angle value;

k) if the majority of the at least two second witness marks of step (i) is proximate the toe region, selecting the at least one iron-type golf club wherein the reference lie angle is substantially equal to the difference between the test lie angle and the first flat lie-angle value;

l) if the majority of the at least two second witness marks of step (i) is proximate the intermediate region, selecting the at least one iron-type golf club wherein the reference lie angle is substantially equal to the difference between the test lie angle and the second flat lie-angle value;

m) if the majority of the at least two second witness marks of step (i) is proximate the heel region, selecting the at least one iron-type golf club wherein the reference lie angle is substantially equal to the difference between the test lie angle and the third flat lie-angle value;

n) if the majority of the at least two first witness marks is proximate the toe region, directing the player to perform a plurality of test swings relative to the oblique hitting surface, with the oblique hitting surface in the upright lie-angle orientation, to impact the gauge against the oblique hitting surface, whereby the at least two second witness marks are produced on the gauge;

o) identifying whether the majority of the at least two second witness marks of step (n) is proximate the toe region, the heel region, or the intermediate region, the toe region associated with a first upright lie-angle value, the intermediate region associated with a second upright lie-angle value, and the heel region associated with a third upright lie-angle value;

p) if the majority of the at least two second witness marks of step (n) is proximate the toe region, selecting the at least one iron-type golf club wherein the reference lie angle is substantially equal to the sum of the test lie angle and the first upright lie-angle value;

q) if the Majority of the at least two second witness marks of step (n) is proximate the intermediate region, selecting the at least one iron-type golf club wherein the reference lie angle is substantially equal to the sum of the test lie angle and the second upright lie-angle value; and r) if the majority of the at least two second witness marks of step (n) is proximate the heel region, selecting the at least one iron-type golf club wherein the reference lie angle is substantially equal to the sum of the test lie angle and the third upright lie-angle value.

5. A method of determining a reference lie angle for at least one iron-type golf club custom-fit for a player, the method comprising:

a) providing a horizontal hitting surface;

b) providing an oblique hitting surface inclined relative to the horizontal surface, the oblique hitting surface comprising a flat lie-angle orientation and an upright lie-angle orientation;

c) providing a test club comprising a sole and a test lie angle, the test club having a predetermined relationship with the at least one iron-type golf club;

d) providing a first gauge and a second gauge, each comprising a toe region, a heel region, and a intermediate region;

e) applying the gauge to the sole of the test club;

f) directing the player to perform at least two test swings relative to the horizontal hitting surface to impact the first gauge against the horizontal hitting surface, whereby at least two first witness marks are produced on the first gauge;

g) identifying whether a majority of the at least two first witness marks is proximate the toe region, the heel region, or the intermediate region;

h) if a majority of the at least two first witness marks are proximate the intermediate region, selecting the at least one iron-type golf club wherein the reference lie angle is substantially equal to the test lie angle;

i) if the majority of the at least two first witness marks is proximate the heel region, removing the first gauge from the sole of the test club, applying the second gauge to the sole of the test club, directing the player to perform at least two test swings relative to the oblique hitting surface, with the oblique hitting surface in the flat lie-angle orientation, to impact the gauge against the oblique hitting surface, whereby at least two second witness marks are produced on the gauge;

j) identifying whether a majority of the at least two second witness marks of step (i) is proximate the toe region, the heel region, or the intermediate region, the toe region associated with a first flat lie-angle value, the intermediate region associated with a second flat lie-angle value, and the heel region associated with a third flat lie-angle value;

k) if the majority of the at least two second witness marks of step (i) is proximate the toe region, selecting the at least one iron-type golf club wherein the reference lie angle is substantially equal to the difference between the test lie angle and the first flat lie-angle value;

l) if the majority of the at least two second witness marks of step (i) is proximate the intermediate region, selecting the at least one iron-type golf club wherein the reference lie angle is substantially equal to the difference between the test lie angle and the second flat lie-angle value;

m) if the majority of the at least two second witness marks of step (i) is proximate the heel region, selecting the at least one iron-type golf club wherein the reference lie angle is substantially equal to the difference between the test lie angle and the third flat lie-angle value;

n) if the majority of the at least two first witness marks is proximate the toe region, removing the first gauge from the sole of the test club, applying the second gauge to the sole of the test club, directing the player to perform at least two test swings relative to the oblique hitting surface, with the oblique hitting surface in the upright lie-angle orientation, to impact the gauge against the oblique hitting surface, whereby the at least two second witness marks are produced on the gauge;

o) identifying whether the majority of the at least two second witness marks of step (n) is proximate the toe region, the heel region, or the inteiuiediate region, the toe region associated with a first upright lie-angle value, the intermediate region associated with a second upright lie-angle value, and the heel region associated with a third upright lie-angle value;

p) if the majority of the at least two second witness marks of step (n) is proximate the toe region, selecting the at least one iron-type golf club wherein the reference lie angle is substantially equal to the sum of the test lie angle and the first upright lie-angle value;

q) if the majority of the at least two second witness marks of step (n) is proximate the intermediate region, selecting the at least one iron-type golf club wherein the reference lie angle is substantially equal to the sum of the test lie angle and the second upright lie-angle value; and r) if the majority of the at least two second witness marks of step (n) is proximate the heel region, selecting the at least one iron-type golf club wherein the reference lie angle is substantially equal to the sum of the test lie angle and the third upright lie-angle value.

6. A method of determining a reference lie angle for at least one iron-type golf club custom-fit for a player, the method comprising:

providing a first hitting surface and a second hitting surface, the first hitting surface being different from the second hitting surface;

providing a test club comprising a data acquisition device;

directing the player to swing the test club relative to the first hitting surface, whereby initial information is collected by the data acquisition device;

determining whether the initial information collected by the data acquisition device satisfies a pre-set condition;

if the condition is satisfied, directing the player to swing the test club relative to the second hitting surface, whereby supplemental information is collected by the data acquisition device; and evaluating the supplemental information collected by the data acquisition device to determine the reference lie angle.

7. A plurality of lie boards for determining a reference lie angle for at least one iron-type club custom-fit for a player, the plurality of lie boards comprising:

a first lie board that, when in a first operating position, rests on a ground plane and comprises a first hitting surface that is horizontal relative to the ground plane; and a second lie board that, when in a second operating position, rests on the ground plane and comprises a second hitting surface that is oblique relative to the ground plane.

* * * * *